US012214852B2

(12) United States Patent
Dannenberg et al.

(10) Patent No.: US 12,214,852 B2
(45) Date of Patent: Feb. 4, 2025

(54) OUTBOARD MOTORS HAVING SIDE AND REAR LAYDOWN CAPABILITY

(71) Applicant: Brunswick Corporation, Mettawa, IL (US)

(72) Inventors: Todd D. Dannenberg, Fond du Lac, WI (US); Matthew Z. Seta, Fond Du Lac, WI (US); Stephen R. Collins, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 538 days.

(21) Appl. No.: 17/554,540

(22) Filed: Dec. 17, 2021

(65) Prior Publication Data

US 2023/0192260 A1 Jun. 22, 2023

(51) Int. Cl.
*B63H 20/32* (2006.01)
*B63H 20/12* (2006.01)

(52) U.S. Cl.
CPC ..... *B63H 20/32* (2013.01); *B63H 20/12* (2013.01); *B63H 2020/323* (2013.01)

(58) Field of Classification Search
CPC .. B63H 20/32; B63H 20/12; B63H 2020/323; B63H 20/00; B63H 20/36; B63H 2020/008; B63H 20/02; B63H 20/08; B63H 20/14
See application file for complete search history.

(56) References Cited

U.S. PATENT DOCUMENTS

| | | | |
|---|---|---|---|
| 1,854,196 | A | 4/1932 | Irgens |
| 3,018,754 | A | 1/1962 | Snyder et al. |
| 3,693,576 | A | 9/1972 | Driscoll |
| 3,865,334 | A | 2/1975 | Wair, Jr. |
| 3,955,527 | A | 5/1976 | Holtermann |
| 3,961,595 | A | 6/1976 | Meyer |
| D246,853 | S | 1/1978 | Berchem |
| 4,071,002 | A | 1/1978 | Frahm |

(Continued)

FOREIGN PATENT DOCUMENTS

| | | |
|---|---|---|
| AU | 2019100942 | 9/2019 |
| CA | 2367740 | 7/2002 |

(Continued)

OTHER PUBLICATIONS

Fergus, et al., Unpublished U.S. Appl. No. 17/487,116.

(Continued)

*Primary Examiner* — Anthony D Wiest
(74) *Attorney, Agent, or Firm* — Andrus Intellectual Property Law, LLP

(57) ABSTRACT

An outboard motor has a cowling, a gearcase, a midsection located axially between the cowling and the gearcase, a steering arm extending forwardly from the midsection, and an anti-ventilation plate between the midsection and the gearcase. A wing extends laterally from the steering arm. The wing, a lateral side of the cowling, and a lateral side of the gearcase together define a side tripod which supports the outboard motor in a side laydown position. The anti-ventilation plate has a rear edge with laterally outer rear support members, which together with the rear of the cowling form a rear tripod which supports the outboard motor in a rear laydown position.

20 Claims, 15 Drawing Sheets

(56) References Cited

U.S. PATENT DOCUMENTS 4,295,835 A 10/1981 Mapes et al.
4,331,431 A 5/1982 Estes
D272,357 S 1/1984 Hall et al.
4,447,214 A 5/1984 Henrich
4,496,326 A 1/1985 Boda
D295,867 S 5/1988 Walsh
4,800,854 A 1/1989 Boda et al.
4,838,820 A 6/1989 Boda et al.
4,878,468 A 11/1989 Boda et al.
4,897,061 A 1/1990 Koepsel et al.
4,911,665 A 3/1990 Hetzel
5,072,809 A 12/1991 Shibata
D323,508 S 1/1992 Hirshberg et al.
D332,265 S 1/1993 Osumi
D341,365 S 11/1993 Little et al.
5,277,634 A 1/1994 Calamia et al.
5,340,342 A 8/1994 Boda et al.
D352,723 S 11/1994 DeBraal et al.
5,378,178 A 1/1995 Haman
D359,290 S 6/1995 Takeuchi
5,509,836 A 4/1996 Ogasawara et al.
5,632,657 A 5/1997 Henderson
D387,775 S 12/1997 Iekura
D412,911 S 8/1999 Iekura
5,967,866 A 10/1999 Willows et al.
D418,519 S 1/2000 Iekura
D421,444 S 3/2000 Hatch et al.
D428,616 S 7/2000 Iekura
D438,493 S 3/2001 Mulliniks et al.
6,264,516 B1 7/2001 Mceathron et al.
D448,037 S 9/2001 Westimayer et al.
6,352,456 B1 3/2002 Jaszewski et al.
D457,166 S 5/2002 Burmeister et al.
D458,273 S 6/2002 Burmeister et al.
6,406,342 B1 6/2002 Walczak et al.
D460,465 S 7/2002 Williams
D460,972 S 7/2002 Osumi
D462,363 S 9/2002 Burmeister et al.
D463,447 S 9/2002 Osumi et al.
D463,448 S 9/2002 Osumi et al.
D463,449 S 9/2002 Osumi
D463,800 S 10/2002 Osumi
D466,907 S 12/2002 Ohsumi
6,494,431 B1 12/2002 McCoy
D470,154 S 2/2003 Burmeister et al.
6,524,148 B2 2/2003 Yoshigasaki et al.
D474,480 S 5/2003 Zebley, Jr. et al.
D474,784 S 5/2003 Sanschagrin et al.
6,558,213 B1 5/2003 McGowan
D478,597 S 8/2003 Zebley, Jr.
6,663,450 B1 12/2003 Walczak et al.
D485,847 S 1/2004 Sanschagrin et al.
D485,848 S 1/2004 Sanschagrin et al.
D486,500 S 2/2004 Okamoto
D489,380 S 5/2004 Ohsumi et al.
D495,345 S 8/2004 Farlow et al.
D495,716 S 9/2004 Sanschagrin et al.
D497,370 S 10/2004 Katoh
D498,485 S 11/2004 Kuwae
D498,764 S 11/2004 Sanschagrin et al.
D500,056 S 12/2004 DeYoung et al.
6,875,066 B2 4/2005 Wolaver
7,001,231 B1 2/2006 Halley et al.
D517,096 S 3/2006 Landers et al.
7,090,551 B1 8/2006 Lokken et al.
D528,128 S 9/2006 Sanschagrin et al.
D528,563 S 9/2006 Sanschagrin et al.
D531,639 S 11/2006 Okamoto
D531,640 S 11/2006 Okamoto
D536,704 S 2/2007 Iekura
D537,838 S 3/2007 Iekura
7,210,973 B2 5/2007 Sanschagri et al.
D549,240 S 8/2007 Okamoto
7,267,592 B1 9/2007 Ingebritson et al.
D560,050 S 1/2008 Tokach et al.
D565,607 S 4/2008 Moen et al.
D578,274 S 10/2008 Tokach et al.
D584,317 S 1/2009 Okamoto
D589,981 S 4/2009 Iekura
D611,062 S 3/2010 Okamoto
D611,063 S 3/2010 Okamoto
7,736,207 B2 6/2010 Vignau
D623,661 S 9/2010 Yamagishi et al.
D624,567 S 9/2010 Kelley
D626,975 S 11/2010 Ryczek et al.
D629,818 S 12/2010 Rummer et al.
D635,154 S 3/2011 Rummer et al.
7,895,959 B1 3/2011 Angel et al.
D635,586 S 4/2011 Okamoto
D643,440 S 8/2011 Dannenberg et al.
D655,320 S 3/2012 Hiraoka et al.
D657,400 S 4/2012 Loew
D660,323 S 5/2012 Hiraoka et al.
D660,614 S 5/2012 Palmeiri
D663,321 S 7/2012 Okamoto
8,257,122 B1 9/2012 Holley
8,651,906 B1 2/2014 Morton
D706,313 S 6/2014 Higashikawa et al.
D707,729 S 6/2014 Jackson et al.
D708,233 S 7/2014 Furuki et al.
D709,918 S 7/2014 Jones, Sr.
D712,931 S 9/2014 Matsumoto
D714,345 S 9/2014 Petit et al.
D715,333 S 10/2014 Jacobsthal et al.
D716,846 S 11/2014 Carter et al.
D727,969 S 4/2015 Okamoto
D728,640 S 5/2015 Turner et al.
9,039,469 B1 5/2015 Calamia et al.
9,073,616 B1 7/2015 Wiegele et al.
D740,858 S 10/2015 Dannenberg et al.
9,180,950 B1 11/2015 Davenport et al.
9,205,906 B1 12/2015 Eichinger
9,216,805 B1 12/2015 Amerling et al.
D757,126 S 5/2016 Vaninetti et al.
9,359,059 B1 6/2016 Scherer, III et al.
9,359,981 B1 6/2016 Waisanen et al.
9,376,194 B1 6/2016 Jensen et al.
9,481,438 B1 11/2016 Tuchscherer
9,580,947 B1 2/2017 Amerling et al.
9,587,601 B1 3/2017 Ochiai
D791,189 S 7/2017 Scherer, III et al.
9,701,383 B1 7/2017 Stuber et al.
D794,078 S 8/2017 Vaninetti
D794,079 S 8/2017 Vaninetti et al.
9,764,813 B1 9/2017 Zarembka et al.
9,783,278 B1 10/2017 Dannenberg et al.
9,789,945 B1 10/2017 Vaninetti et al.
9,840,316 B1 12/2017 Jaszewski
D806,752 S 1/2018 Vaninetti et al.
D807,920 S 1/2018 Vaninetti
D809,017 S 1/2018 Noda et al.
9,926,064 B1 3/2018 Tuchscherer
D816,716 S 5/2018 Abellera et al.
D832,472 S 10/2018 Davis et al.
D834,617 S 11/2018 Zin et al.
D834,618 S 11/2018 Zin et al.
D835,675 S 12/2018 Nakaura et al.
D842,504 S 3/2019 Davis et al.
10,246,173 B1 4/2019 Ingebritson
D852,230 S 6/2019 Zin et al.
D852,848 S 7/2019 Zin et al.
D852,849 S 7/2019 Zin et al.
D852,850 S 7/2019 Zin et al.
D859,469 S 9/2019 Zin et al.
10,696,367 B1 6/2020 Ingebritson et al.
10,787,236 B1 9/2020 Erickson
10,940,917 B2 3/2021 Montague et al.
D917,565 S 4/2021 Vaninetti et al.
10,981,639 B2 * 4/2021 Kimpara ..... B63H 20/32
11,084,563 B1 8/2021 Pielow et al.
11,097,824 B1 8/2021 Anderson, Jr.
11,097,826 B1 8/2021 Dannenberg et al.
11,186,352 B1 11/2021 Ingebritson et al.
2003/0024456 A1 2/2003 Swetish

(56) References Cited

U.S. PATENT DOCUMENTS

| | | | |
|---|---|---|---|
| 2003/0194927 | A1 | 10/2003 | Sanschagrin et al. |
| 2003/0232548 | A1 | 12/2003 | Alby et al. |
| 2006/0172631 | A1 | 8/2006 | Kameoka |
| 2007/0042652 | A1 | 2/2007 | Kitsu et al. |
| 2009/0075534 | A1 | 3/2009 | Wiatrowski et al. |
| 2010/0147257 | A1 | 6/2010 | Yazaki et al. |
| 2013/0280970 | A1 | 10/2013 | Clarkson et al. |
| 2014/0057508 | A1 | 2/2014 | Litjens et al. |
| 2016/0023740 | A1 | 1/2016 | Skrzypchak et al. |
| 2017/0306830 | A1 | 10/2017 | Bruestle et al. |

FOREIGN PATENT DOCUMENTS

| | | | | | |
|---|---|---|---|---|---|
| EP | 1101696 | | | 5/2001 | |
| EP | 3326903 | | | 4/2019 | |
| JP | S60 38293 | | | 2/1985 | |
| JP | 2002211489 | A | * | 7/2002 | ..... B63H 20/00 |
| JP | 2010058770 | A | * | 3/2010 | ..... B63H 20/32 |
| JP | 2011-213215 | | | 10/2011 | |
| JP | 2013-17342 | | | 9/2013 | |
| JP | 5604939 | B2 | * | 10/2014 | |
| WO | 2004-035381 | | | 4/2004 | |
| WO | WO-2007097057 | A1 | * | 8/2007 | ..... B63H 20/00 |

OTHER PUBLICATIONS

Jaszewski, et al., Unpublished U.S. Appl. No. 17/585,214.
Extended European Search Report for EP 23 156069.9, dated Jul. 10, 2023.
Extended European Search Report issued in Corresponding EP Application No. 22211031.4, dated May 17, 2023.

* cited by examiner

OUTBOARD MOTORS HAVING SIDE AND REAR LAYDOWN CAPABILITY

FIELD

The present disclosure relates to outboard motors and particularly to outboard motors which are manually transportable and have side and rear laydown capability.

BACKGROUND

The following are incorporated herein by reference, in entirety.

U.S. Pat. No. 9,205,906 discloses a mounting arrangement for supporting an outboard motor with respect to a marine vessel extending in a fore-aft plane. The mounting arrangement comprises first and second mounts that each have an outer shell, an inner wedge concentrically disposed in the outer shell, and an elastomeric spacer between the outer shell and the inner wedge. Each of the first and second mounts extend along a axial direction, along a vertical direction which is perpendicular to the axial direction, and along a horizontal direction which is perpendicular to the axial direction and perpendicular to the vertical direction. The inner wedges of the first and second mounts both have a non-circular shape when viewed in a cross-section taken perpendicular to the axial direction. The non-circular shape comprises a first outer surface which extends laterally at an angle to the horizontal and vertical directions. The non-circular shape comprises a second outer surface which extends laterally at a different, second angle to the horizontal and vertical directions. A method is for making the mounting arrangement.

U.S. Pat. No. 9,701,383 discloses a marine propulsion support system having a transom bracket, a swivel bracket, and a mounting bracket. A drive unit is connected to the mounting bracket by a plurality of vibration isolation mounts, which are configured to absorb loads on the drive unit that do not exceed a mount design threshold. A bump stop located between the swivel bracket and the drive unit limits deflection of the drive unit caused by loads that exceed the threshold. An outboard motor includes a transom bracket, a swivel bracket, a cradle, and a drive unit supported between first and second opposite arms of the cradle. First and second vibration isolation mounts connect the first and second cradle arms to the drive unit, respectively. An upper motion-limiting bump stop is located remotely from the vibration isolation mounts and between the swivel bracket and the drive unit.

U.S. Pat. No. 9,764,813 discloses a tiller for an outboard motor. The tiller comprises a tiller body that is elongated along a tiller axis between a fixed end and a free end. A throttle grip is disposed on the free end. The throttle grip is rotatable through a first (left-handed) range of motion from an idle position in which the outboard motor is controlled at idle speed to first (left-handed) wide open throttle position in which the outboard motor is controlled at wide open throttle speed and alternately through a second (right handed) range of motion from the idle position to a second (right-handed) wide open throttle position in which the outboard motor is controlled at wide open throttle speed.

U.S. Pat. No. 11,097,824 discloses an apparatus for steering an outboard motor with respect to a marine vessel. The apparatus includes a transom bracket configured to support the outboard motor with respect to the marine vessel; a tiller for manually steering the outboard motor with respect to a steering axis; a steering arm extending above the transom bracket and coupling the tiller to the outboard motor such that rotation of the tiller causes rotation of the outboard motor with respect to the steering axis, wherein the steering arm is located above the transom bracket; and a copilot device configured to lock the outboard motor in each of a plurality of steering positions relative to the steering axis. The copilot device extends above and is manually operable from above the steering arm.

U.S. patent application Ser. No. 17/487,116 discloses an outboard motor including a transom clamp bracket configured to be supported on a transom of a marine vessel and a swivel bracket configured to be supported by the transom clamp bracket. A propulsion unit is supported by the swivel bracket, the propulsion unit comprising a head unit, a midsection below the head unit, and a lower unit below the midsection. The head unit, midsection, and lower unit are generally vertically aligned with one another when the outboard motor is in a neutral tilt/trim position. The propulsion unit is detachable from the transom clamp bracket.

SUMMARY

This Summary is provided to introduce a selection of concepts which are further described herein below in the Detailed Description. This Summary is not intended to identify key or essential features of the claimed subject matter, nor is it intended to be used as an aid in limiting scope of the claimed subject matter.

In non-limiting examples disclosed herein, an outboard motor extends from top to bottom in an axial direction, from side to side in a lateral direction which is perpendicular to the axial direction, and from front to rear in a longitudinal direction which is perpendicular to the axial direction and perpendicular to the lateral direction. The outboard motor has a cowling; a gearcase; a midsection located axially between the cowling and the gearcase; a steering arm extending forwardly from the midsection; and a wing extending laterally from the steering arm, wherein the wing, a lateral side of the cowling, and a lateral side of the gearcase together define a side tripod which supports the outboard motor in a side laydown position.

In other non-limiting examples disclosed herein, a tiller handle extends forwardly from the steering arm. The wing is located rearwardly of the tiller handle and forwardly of the midsection and a support member on the lateral side of the cowling. The support member is configured to support the outboard motor in the side laydown position, along with the wing and the lateral side of the gearcase. The wing comprises a frame having an inner end coupled to the steering arm and an outer end having a footing with a planar surface for supporting the outboard motor in the side laydown position, along with the lateral side of the cowling and the lateral side of the gearcase.

In other non-limiting examples disclosed herein, the outboard motor has an anti-ventilation plate between the midsection and the gearcase, the anti-ventilation plate having a rear edge with laterally outer rear support members, which together with the rear of the cowling form a rear tripod which supports the outboard motor in a rear laydown position.

BRIEF DESCRIPTION OF THE DRAWINGS

Examples are described with reference to the following drawing figures. The same numbers are used throughout to reference like features and components.

DETAILED DESCRIPTION

During research and development in the field of marine propulsion devices, the present applicant determined it would be advantageous to provide improved locking apparatuses for removably coupling a marine drive, for example an outboard motor, to a marine vessel. Further, the present applicant determined it would be advantageous to provide improved copilot apparatuses for selectively retaining the marine drive in various steering orientations. Further, the present applicant determined it would be advantageous to integrate a copilot apparatus with a locking apparatus, to provide a more efficient and effective means for collectively locking, unlocking, and retaining the steering orientation of the marine drive relative to the marine vessel, which advantageously reduces chance of user error, limits the chance of accidentally damaging the apparatus, and enhances overall user experience.

Figure 1:
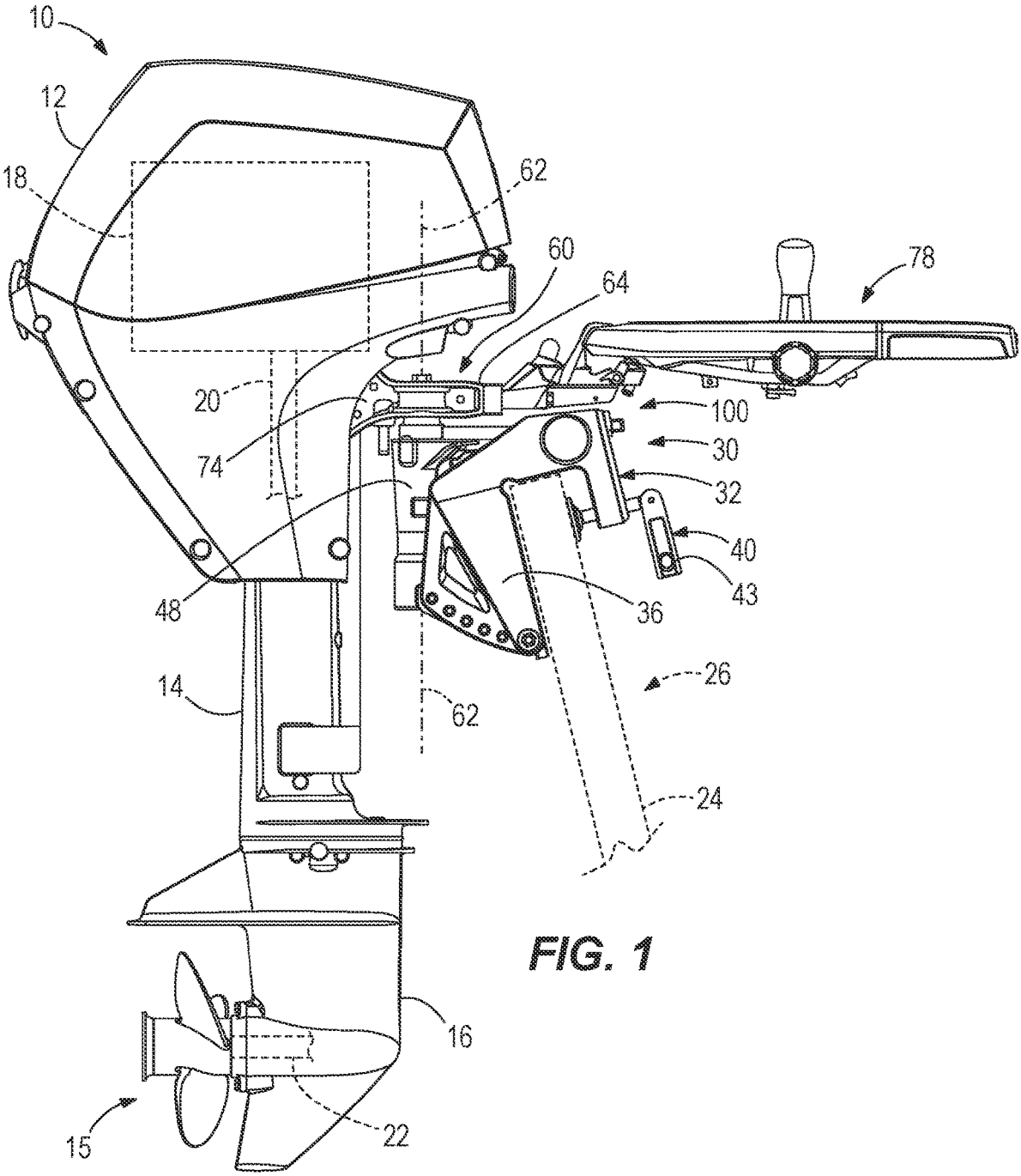
FIG. 1 is a side view of a marine drive supported on the transom of a marine vessel by an apparatus according to the present disclosure.

FIG. 1 depicts a marine drive, which in the illustrated example is an outboard motor 10. The outboard motor 10 has an upper cowling 12 and a driveshaft housing 14 extending downwardly from the upper cowling 12 to a lower gearcase 16. A powerhead 18 is covered by the upper cowling 12. The powerhead 18 causes rotation of a driveshaft 20 which extends from the powerhead 18 through the driveshaft housing 14 and into operative engagement with a propeller shaft 22 supported for rotation in the lower gearcase 16. The powerhead 18 can include an electric motor and/or an engine and/or any other conventional means for causing rotation of the driveshaft 20. Rotation of the driveshaft 20 causes rotation of the propeller shaft 22, which in turn causes rotation of a propeller 15. The type and configuration of the marine drive can vary from what is shown and in other examples can include a forward-facing or tractor-type propeller configuration, an impeller, and/or any other known means for generating a propulsive force for propelling a marine vessel in water.

Figure 2:
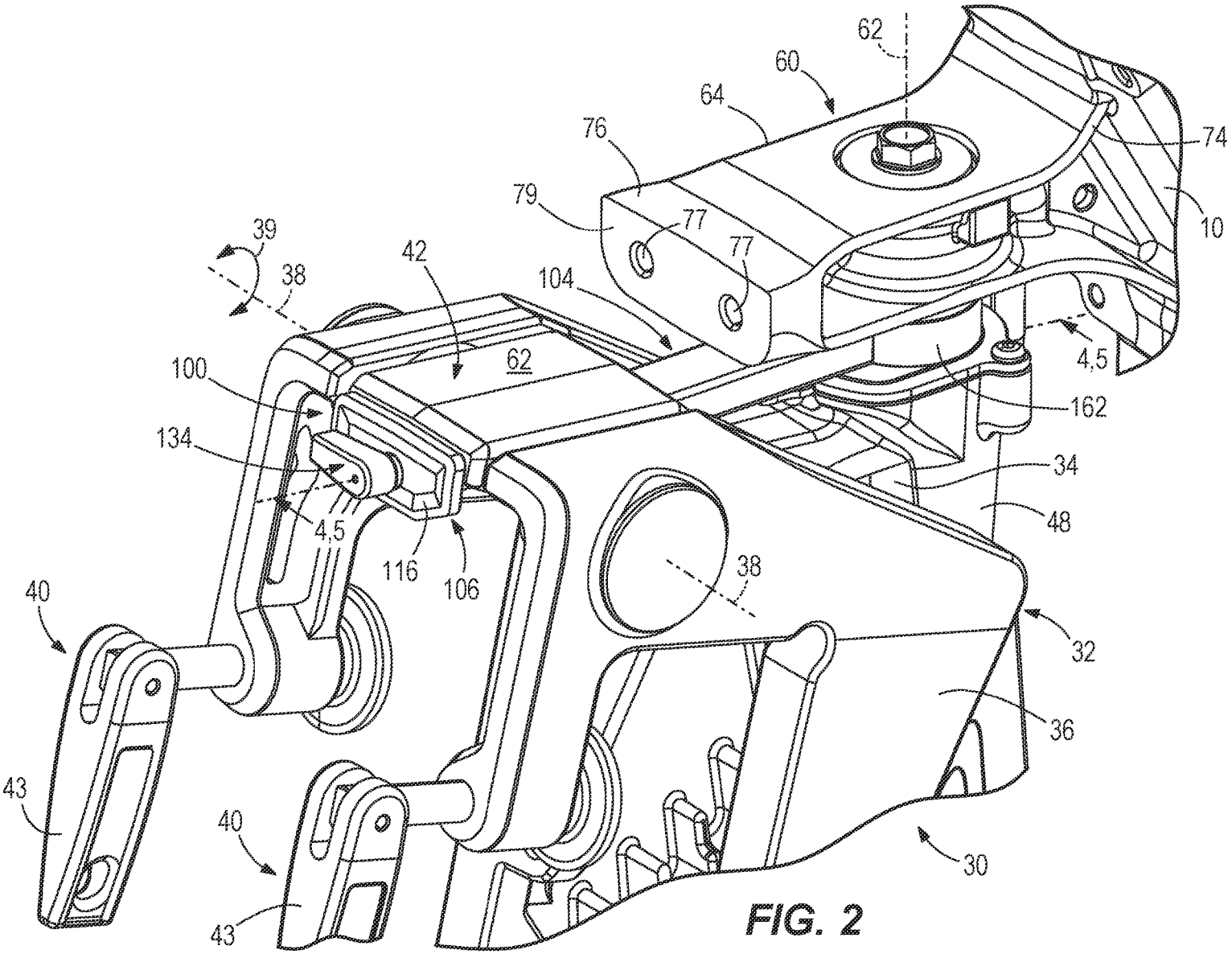
FIG. 2 is a closer view of the apparatus, including a transom bracket assembly, a swivel bracket, and an integrated copilot and locking mechanism.

Referring to FIGS. 1 and 2, the outboard motor 10 is coupled to the transom 24 of a marine vessel 26 by a transom bracket assembly 30 which in the illustrated example includes a transom bracket 32 fixed to the transom 24 and a swivel bracket 34 pivotably coupled to the transom bracket 32. The transom bracket 32 has a pair of C-shaped arms 36 which fit over the top of the transom 24 and a pair of threaded, plunger-style clamps 40 which clamp the C-shaped arms 36 to the transom 24. Rotation of handles 43 in one direction clamps the transom 24 between the C-shaped arms 36 and plunger-style clamps 40. Rotation of the handles 43 in the opposite direction frees the C-shaped arms 36 for removal from the transom 24. The type and configuration of the transom bracket 32 can vary from what is shown and described. In other examples, the transom bracket 32 is fixed to the transom 24 by fasteners.

The swivel bracket 34 is pivotably coupled to the upper end of the C-shaped arms 36 along the trim axis 38 such that the swivel bracket 34 is pivotable (trimmable) up and down about the trim axis 38 in the direction of arrows 39. Reference is made to the above-incorporated U.S. patents, which show similar conventional arrangements facilitating pivoting movement of a swivel bracket relative to a transom bracket. This is a conventional arrangement and thus is not further discussed herein. It should also be mentioned for completeness that for the purposes of the present invention, the transom bracket assembly 30 does not have to have a swivel bracket which is pivotable (trimmable) relative to a transom bracket. In other arrangements, the transom bracket assembly could be comprised of a single monolithic component or could be comprised of more than one component which are not pivotable about a trim axis.

Figure 3:
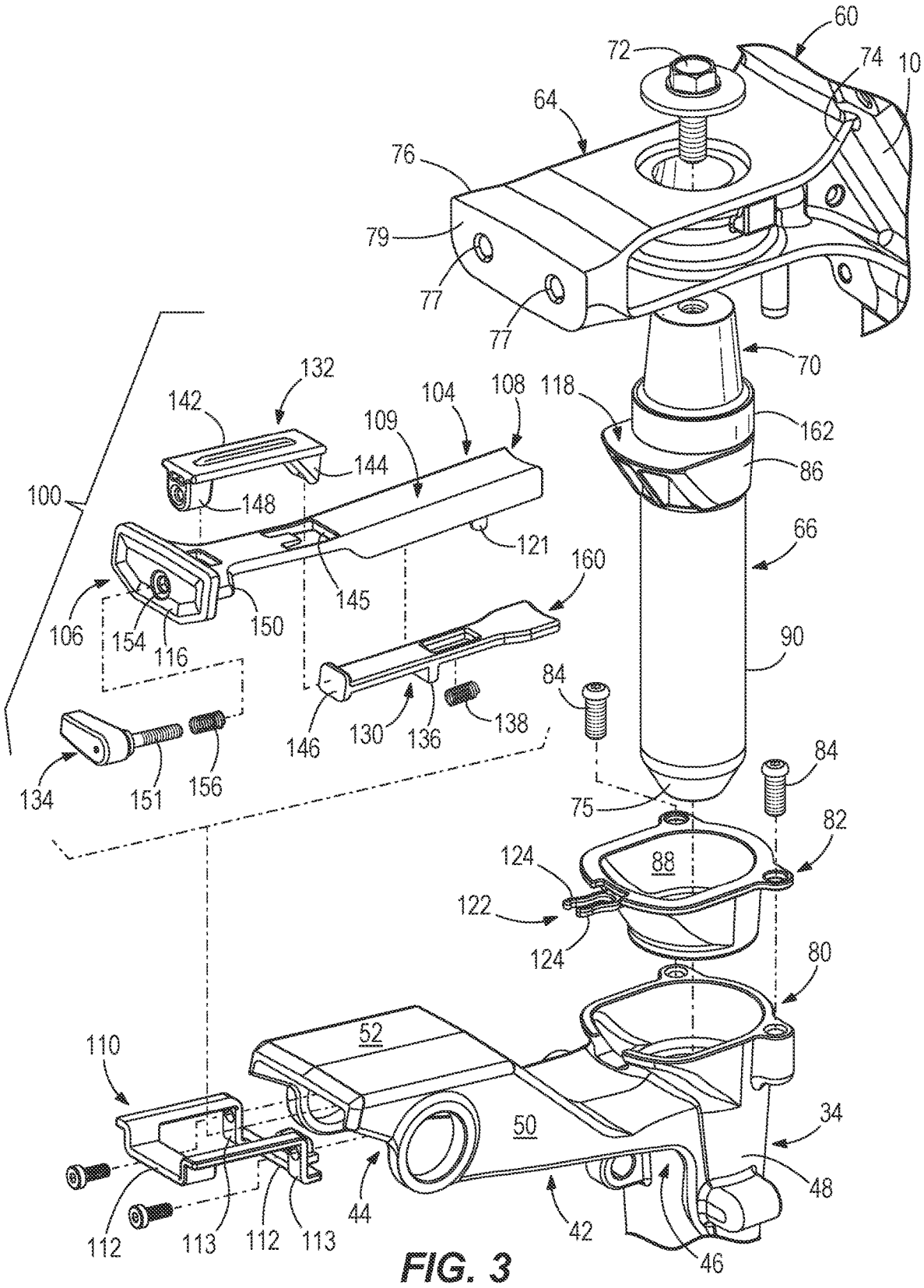
FIG. 3 is an exploded view of the apparatus shown in FIG. 2.
Figure 4:
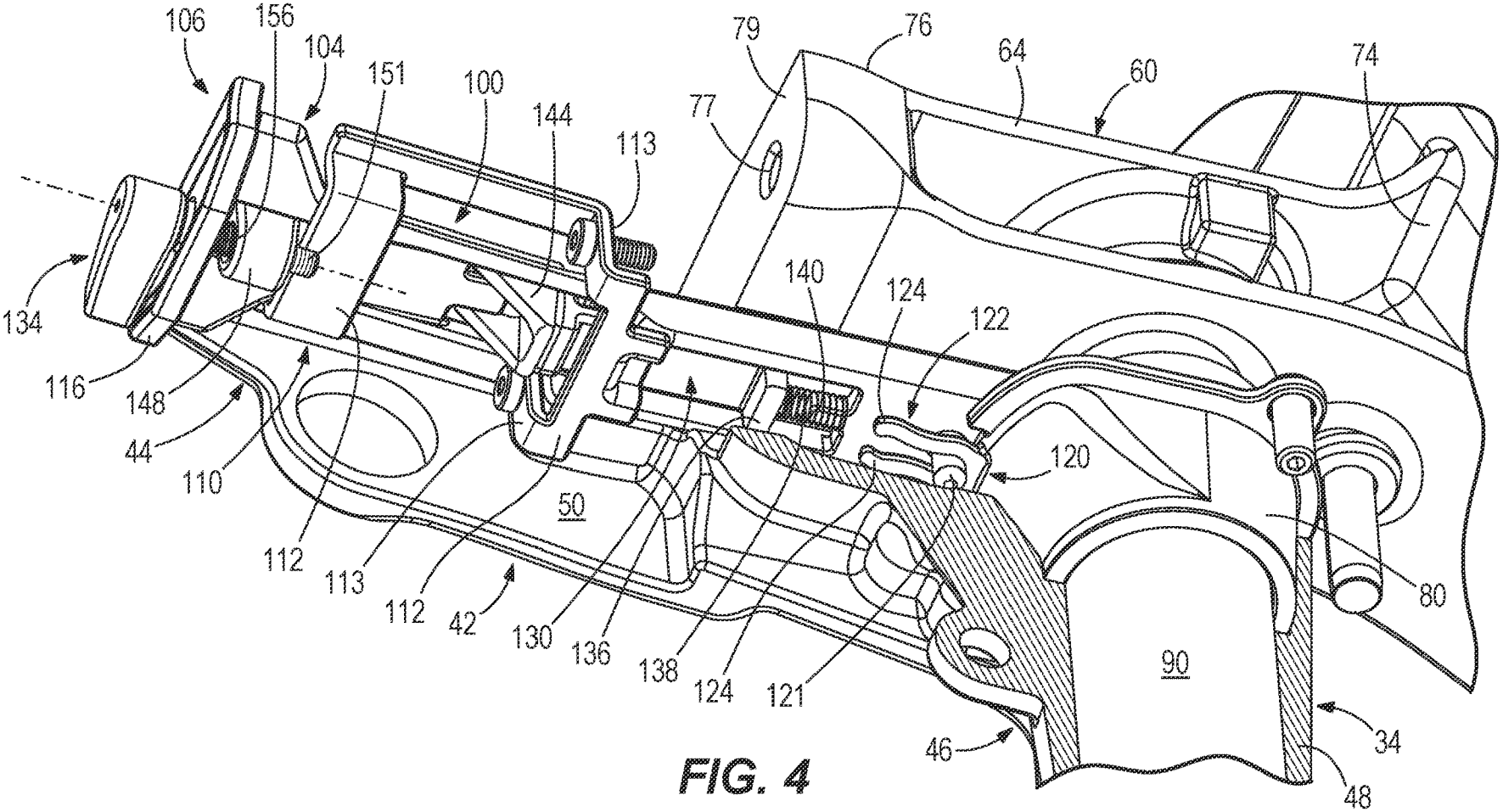
FIG. 4 is a view of section 4-4, taken in FIG. 2.

Referring now to FIG. 3, the swivel bracket 34 includes a swivel arm 42 having a first end 44 which is pivotably coupled to the C-shaped arms 36 of the transom bracket 32, along the trim axis 38. The swivel arm 42 has an opposite, second end 46 which is fixed to or formed with an elongated swivel cylinder 48, which is further described herein below with reference to FIG. 5. As best shown in FIGS. 3 and 4, the first end 44 of the swivel arm 42 has a pair of sidewalls 50 and a top wall 52 which connects the sidewalls 50. An axial passage 54 (see FIG. 5) is formed through the middle of the swivel arm 42, between the first and second ends 44, 46, and generally next to the top wall 52 and next to and between the sidewalls 50.

Referring to FIGS. 1-3, a steering bracket 60 is fixed to and extends from the outboard motor 10, generally along the midsection of the outboard motor 10, adjacent the lower portion of the upper cowling 12 and the upper portion of the driveshaft housing 14. As will be further described herein below, the steering bracket 60 facilitates removable coupling of the outboard motor 10 to the transom bracket assembly 30, i.e., so that the outboard motor 10 is steerable relative to the transom bracket assembly 30 about a steering axis 62 and so that the outboard motor 10 is removable from the transom bracket assembly 30 for transport along with the outboard motor 10. The steering bracket 60 has a steering arm 64 and a swivel tube assembly 66. The swivel tube assembly 66 is cylindrical, having a smooth outer surface which extends generally laterally to the steering arm 64 from an upper end 70 fixed to a middle portion of the steering arm 64 by a fastener 72 to a conical lower end 75. The steering arm 64 has a first end 74 which is fixed to a supporting frame or other component of the outboard motor 10, as described herein above, and an opposite, second end 76 fixed to a conventional tiller handle 78, shown in FIG. 1, by fasteners extending through bores 77 in the end wall 79 of the steering arm 64. The type and configuration of the tiller handle 78 can vary from what is shown. The illustrated example is the tiller handle disclosed in the presently incorporated U.S. Pat. No. 9,764,813.

Referring to FIG. 3, the outboard motor 10 is installed onto the swivel bracket 34 by lowering the swivel tube assembly 66 into the swivel cylinder 48, as shown by dash-and-dot line in FIG. 3. The swivel cylinder 48 has a widened mouth 80. A receiver cup 82 is nested in the widened mouth 80 and affixed thereto by fasteners 84. An annular locking flange 86 is fixed to the upper end 70 of the swivel tube assembly 66. The receiver cup 82 and annular locking flange 86 have complementary inner and outer shapes, respectively, and as such are configured so that the annular locking flange 86 nests in the receiver cup 82 as the swivel tube assembly 66 is lowered into and seated in the swivel cylinder 48. The receiver cup 82 has an inner funnel surface 88 which centrally funnels the conical lower end 75 of the swivel tube assembly 66 into the swivel cylinder 48 as the swivel tube assembly 66 is lowered into the receiver cup 82. The smooth outer surface of the swivel tube assembly 66 facilitates sliding of the swivel tube assembly 66 along the smooth inner surface of the swivel cylinder 48 until the annular locking flange 86 engages and nests in the receiver cup 82. Engagement between the outer contours of the annular locking flange 86 with the inner (funnel) contours of the receiver cup automatically aligns the swivel tube assembly 66 about the steering axis 62, particularly into the position shown in FIG. 5.

Figure 5:
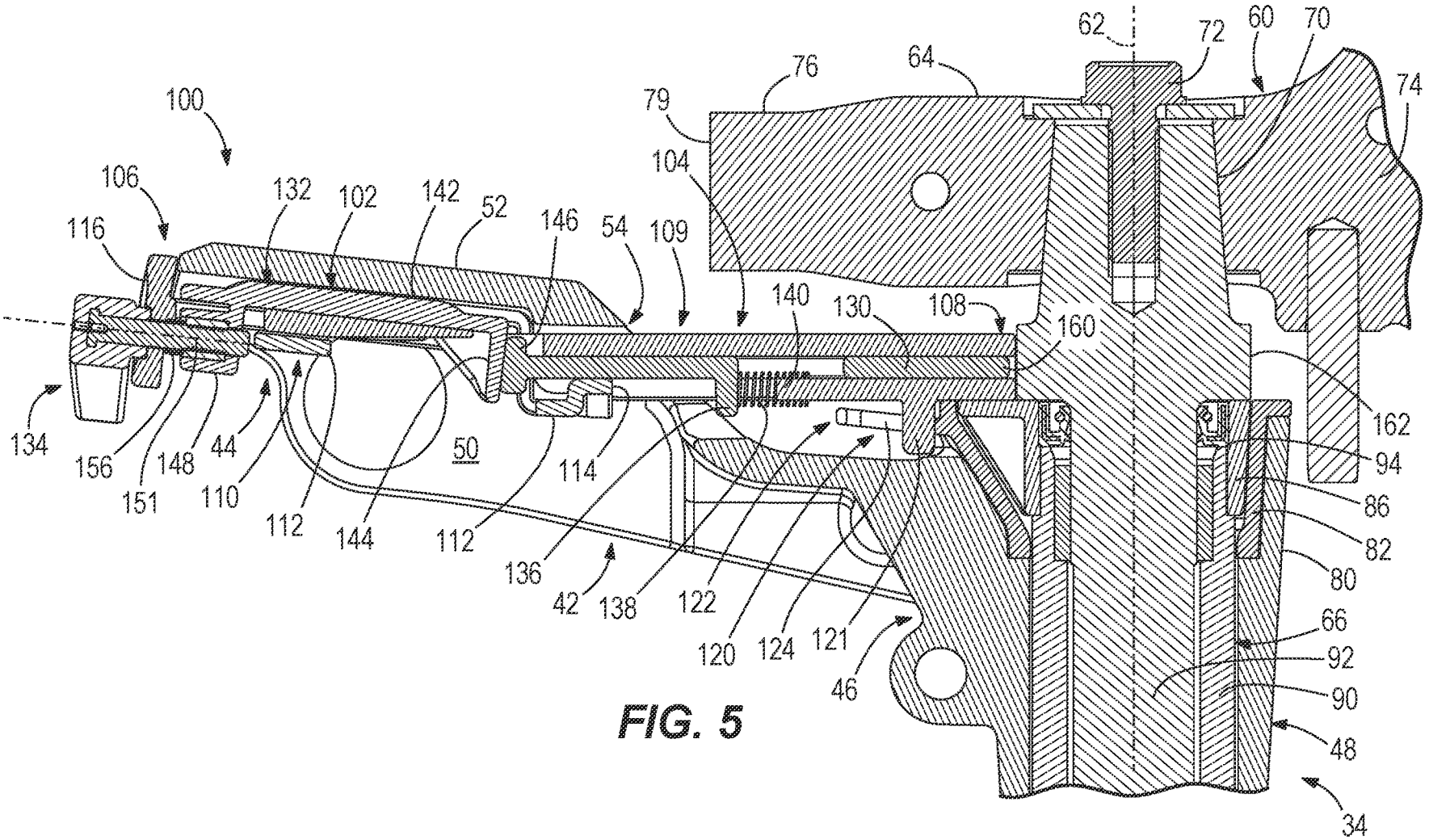
FIG. 5 is a view of section 5-5, taken in FIG. 2, showing the mechanism in a locked position wherein the marine drive is retained on the marine vessel and steerable about a steering axis.

Referring to FIG. 5, the swivel tube assembly 66 has a stationary outer cylinder 90 and a rotatable inner cylinder 92, which is coaxial with and disposed within the outer cylinder 90. The upper end of the inner cylinder 92 is fixed to the steering arm 64 by the fastener 72 such that manually steering the tiller handle 78 about the steering axis 62, as will be further described herein below, rotates the steering arm 64 and the inner cylinder 92 together about the steering axis 62, while the outer cylinder 90 and annular locking flange 86 remain stationary relative to the steering axis 62 due to the noted nested engagement between the annular locking flange 86 and the receiver cup 82. Bearings 94 facilitate rotational (steering) movement of the inner cylinder 92 relative to the outer cylinder 90 of the swivel tube assembly 66.

Now referring to FIGS. 3 and 4, a novel integrated copilot and locking mechanism 100 is configured to retain the steering bracket 60 in a plurality of steering orientations relative to the steering axis 62. The mechanism 100 is also configured to lock and alternately unlock the steering bracket 60 relative to the transom bracket assembly 30 such that in a locked position of the mechanism 100 the outboard motor 10 is retained on the transom bracket assembly 30 and thus on the marine vessel 26, and such that in an unlocked position of the mechanism 100 the outboard motor 10 is removable therefrom.

Generally, the mechanism 100 has a copilot arm 102 (consisting of several components in the illustrated embodiment) for retaining the steering bracket 60 in a selected steering orientation about the steering axis 62 and for releasing the steering bracket 60 so that the outboard motor 10 is freely steerable about the steering axis 62. The mechanism 100 also has a locking arm 104 for locking and for alternately unlocking the steering bracket 60 and thus the outboard motor 10 relative to the transom bracket assembly 30 and thus the marine vessel 26. As shown and described herein below, the copilot arm 102 and the locking arm 104 are parallel and coaxial, with the copilot arm 102 being integrated within the locking arm 104 and supported on and movable relative to the locking arm 104.

Referring to FIGS. 3-4, the locking arm 104 is generally laterally elongated relative to the steering axis 62, extending along the steering arm 64, perpendicularly relative to the steering axis 62. The locking arm 104 has a first, handle end 106, an opposite second, locking end 108, and a middle portion 109 between the handle end 106 and the locking end 108. The middle portion 109 of the locking arm 104 extends along the swivel arm 42, through the noted axial passage 54. A cradle bracket 110 couples the locking arm 104 to the bottom of the handle end 106 of the steering arm 64 so that the locking arm 104 is slidable along the steering arm 64, radially towards and away from the swivel tube assembly 66. The cradle bracket 110 has opposing cross-arms 112 for supporting the locking arm 104 and opposing bracket arms 113 which are fastened to end walls 114 along the bottom of the steering arm 64, adjacent to the axial passage 54.

Figure 6:
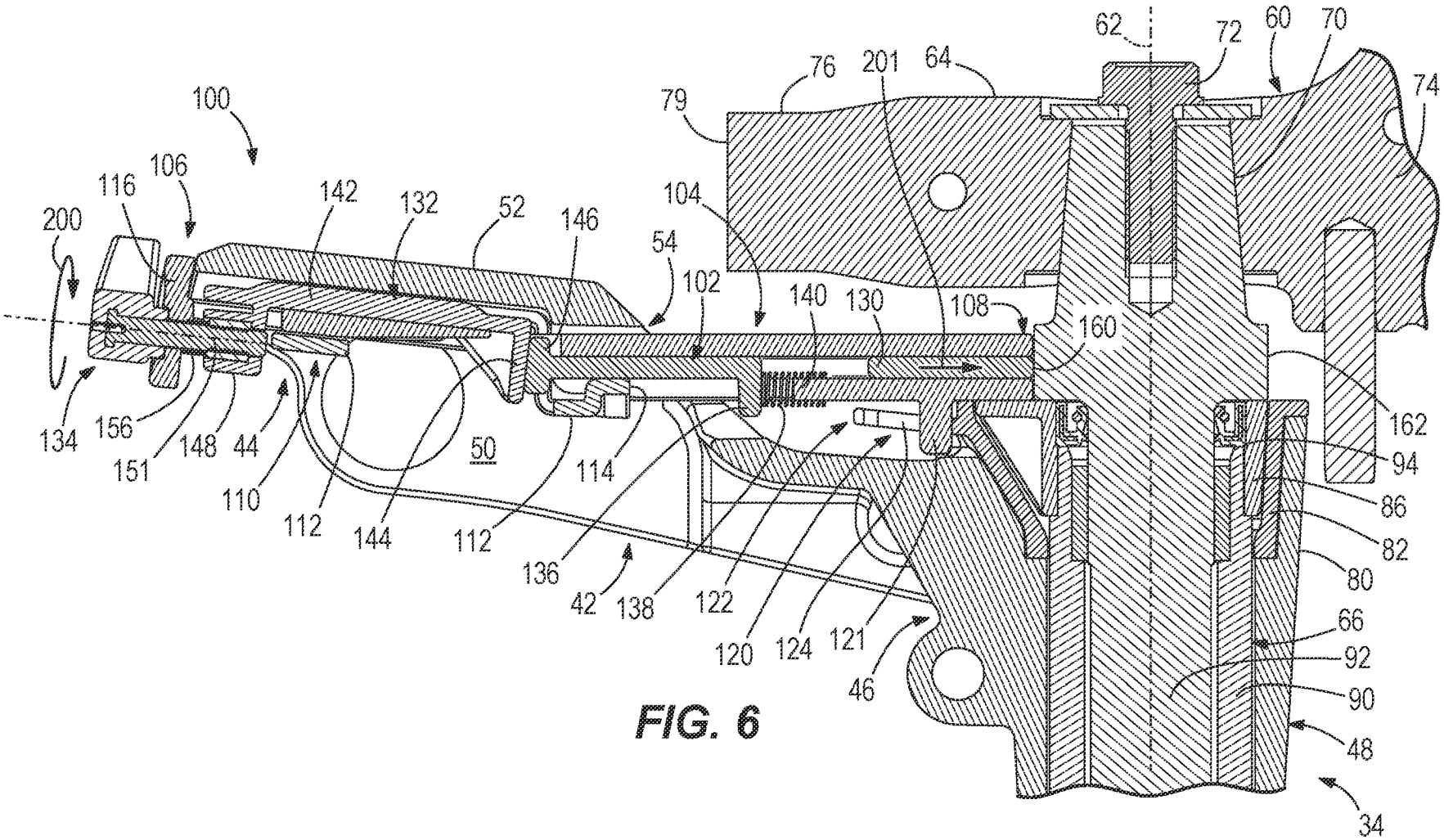
FIG. 6 is a view like FIG. 5, showing the mechanism in the locked position wherein the marine drive is further retained in a steering orientation relative to the steering axis.

An end flange 116 is disposed on the handle end 106. As will be described in further detail herein below with reference to FIGS. 5-8, the end flange 116 provides a locking handle which facilitates manual grasping and pulling/sliding of the locking arm 104 radially outwardly from the swivel tube assembly 66 to remove the locking end 108 from over a top flange 118 (see FIGS. 3 and 7) of the annular locking flange 86 to free or unlock the outboard motor 10 for removal from the transom bracket assembly 30. The end flange 116 also facilitates pushing/sliding of the locking arm 104 radially inwardly towards the swivel tube assembly 66 to move the locking end 108 over top of the top flange 118 (as shown in FIGS. 5 and 6) for locking the swivel tube assembly 66 on the transom bracket assembly 30 and thus preventing removal of the outboard motor 10 from the transom bracket assembly 30.

A detent device 120 retains the locking arm 104 in a locked position (shown in FIGS. 5-6 and described herein below) and in an unlocked position (shown in FIG. 7 and described herein below). The type and configuration of the detent device can vary from what is shown and described. In the illustrated example, the detent device 120 has a detent protrusion 121 extending from the bottom of the locking end 108 of the locking arm 104 and a spring clip 122 which radially extends from an upper flange on the receiver cup 82. The spring clip 122 has a pair of resilient arms 124 which are contoured to define therebetween an open outer end for receiving the detent protrusion 121, a first (outer) recess for retaining the detent protrusion 121 when the locking arm 104 is in the unlocked position, and a second (inner) recess which is located closer to the receiver cup 82 for retaining the detent protrusion 121 when the locking arm 104 is in the locked position.

Referring to FIG. 3, the copilot arm 102 has a friction arm 130, a shuttle 132, and a handle or knob 134. The friction arm 130 and shuttle 132 extend generally parallel to and coaxial with the locking arm 104. The friction arm 130 is disposed in an elongated channel formed through the locking end 108 of the locking arm 104 and is slidable along the locking arm 104. A spring 138 has a first end which abuts an abutment wall 136 on the bottom of the friction arm 130 and an opposite, second end disposed on a spring retention finger 140 on the bottom of the locking end 108 of the locking arm 104. The natural resiliency of the spring 138 pushes the abutment wall 136 and spring retention finger 140 apart, thus biasing the friction arm 130 towards and into engagement with the shuttle 132, as shown in FIG. 4.

The shuttle 132 is embedded in the top of the locking arm 104, having an elongated shuttle body 142, an abutment flange 144 which extends downwardly from the shuttle body 142 through a recess 145 in the middle portion 109 of the locking arm 104 and into engagement with an outer end flange 146 on the friction arm 130, and a threaded boss 148 extending downwardly from the shuttle body 142 through a recess 150 in the handle end 106 of the locking arm 104. The threaded boss 148 is engaged with a threaded shaft 151 on the knob 134, which extends through an unthreaded hole 154 in the end flange 116. A spring 156 has a first end abutting the boss 148 and an opposite, second end abutting the rear side of the end flange 116, opposite the knob 134. The natural resiliency of the spring 156 tends to push the shuttle 132 apart from the rear side of the end flange 116. Manually rotating the knob 134 in a first direction causes the threaded boss 148 of the shuttle 132 to travel inwardly towards the swivel tube assembly 66, which moves (shuttles) the shuttle 132 inwardly along the locking arm 104. Moving the shuttle 132 inwardly pushes the friction arm 130 inwardly towards the swivel tube assembly 166, until the inner end 160 of the friction arm 130 engages with an annular friction ring 162 on the inner cylinder 92 of the of the swivel tube assembly 66. Optionally the inner end 160 of the friction arm 130 has a concave surface which generally conforms the inner end 160 to the outer surface of the annular friction ring 162, thus facilitating frictional engagement therebetween. Frictional engagement between the inner end 160 and the annular friction ring 162 frictionally retains the steering orientation the inner cylinder 92 and the associated steering arm 64 and thus the outboard motor 10 which is rigidly attached to the steering arm 64.

Conversely, manually rotating the knob 134 in the opposite, second direction causes the threaded boss 148 and associated shuttle 132 to travel (shuttle) outwardly away from the swivel tube assembly 166 along the locking arm 104. Moving the shuttle 132 outwardly allows the natural bias of the spring 138 to move the friction arm 130 away from the annular friction ring 162, thus removing the frictional engagement between the inner end 160 and the annular friction ring 162, which in turn frees the swivel tube assembly 66 and associated outboard motor 10 for steering movement about the steering axis 62, as described herein above.

Advantageously, the copilot arm 102 is configured such that via the degree of rotation of the knob 158, the friction arm 130 is selectively movable inwardly towards and alternately outwardly away from the annular friction ring 162, allowing the user to vary the strength of frictional engagement between the copilot arm 102 and the swivel tube assembly 66, thus providing the ability to selectively vary an amount of resistance against steering motions of the steering bracket 60 relative to the transom bracket assembly 30. Thus, the mechanism 100 permits the user to control the degree of resistance to steering movements of the outboard motor 10 via the tiller handle 78, i.e., according to personal preference. Some users prefer more resistance to steering inputs than others, as a personal choice. The mechanism 100 advantageously permits this characteristic to be selectively varied and set by the user.

FIG. 5 depicts the mechanism 100 in the locked position, in which the steering bracket 60 is retained on the transom bracket assembly 30. The copilot arm 102 is shown disengaged from the swivel tube assembly 66 such that the steering bracket 60 and associated outboard motor 10 are freely steerable about the steering axis 62 via the tiller handle 78. As explained herein above, during installation the swivel tube assembly 66 is lowered into the steering bracket 60 such that the annular locking flange 86 becomes nested in the receiver cup 82. Then, the end flange 116 is manually pushed inwardly towards the swivel tube assembly 66 to move the locking end 108 over the top of the top flange 118, which locks the swivel tube assembly 66 on the transom bracket assembly 30. In other words, the locking end 108 prevents upward movement of the annular locking flange 86 and thus prevents removal of the swivel tube assembly 66 from the swivel cylinder 48. Movement of the locking end 108 over the top of the top flange 118 also moves the detent protrusion 121 from the outer recess to the inner recess of the spring clip 122, which retains the locking arm 104 in the position shown. The knob 134 is shown rotated into position wherein the shuttle 132 is moved outwardly away from the swivel tube assembly 166, permitting the natural bias of the spring 138 to move the friction arm 130 away from the annular friction ring 162, as shown, thus preventing frictional engagement between the inner end 160 and the annular friction ring 162, which frees the swivel tube assembly 66 and associated outboard motor 10 for steering movement.

FIG. 6 depicts the mechanism 100 in the locked position after the copilot handle 158 has been manually rotated, as shown at arrow 200, such that the shuttle 132 is moved inwardly towards the swivel tube assembly 166, shown at arrow 201, which in turn moves the friction arm 130 towards and into frictional engagement with the annular friction ring 162, which frictional engagement resists or prevents steering movement of the swivel tube assembly 66 and associated tiller handle 78 and outboard motor 10 relative to the transom bracket assembly 30. Thus, FIG. 6 depicts the mechanism 100 in the locked position wherein the copilot arm 102 restricts steering movement of the outboard motor 10 about the steering axis 62.

Figure 7:
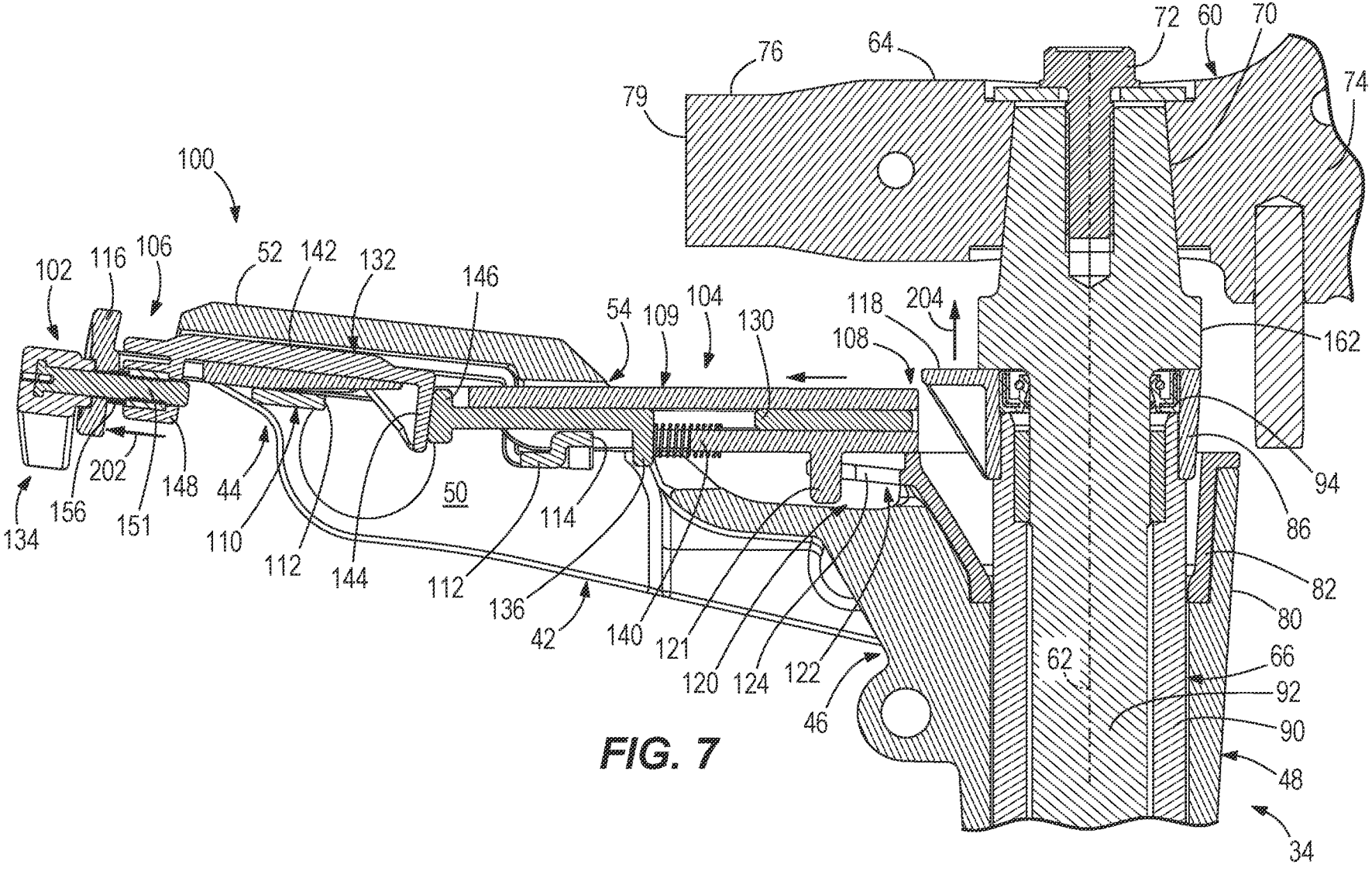
FIG. 7 is a view like FIG. 6, showing the mechanism in an unlocked position, permitting removal of the marine drive from the marine vessel.
Figure 8:
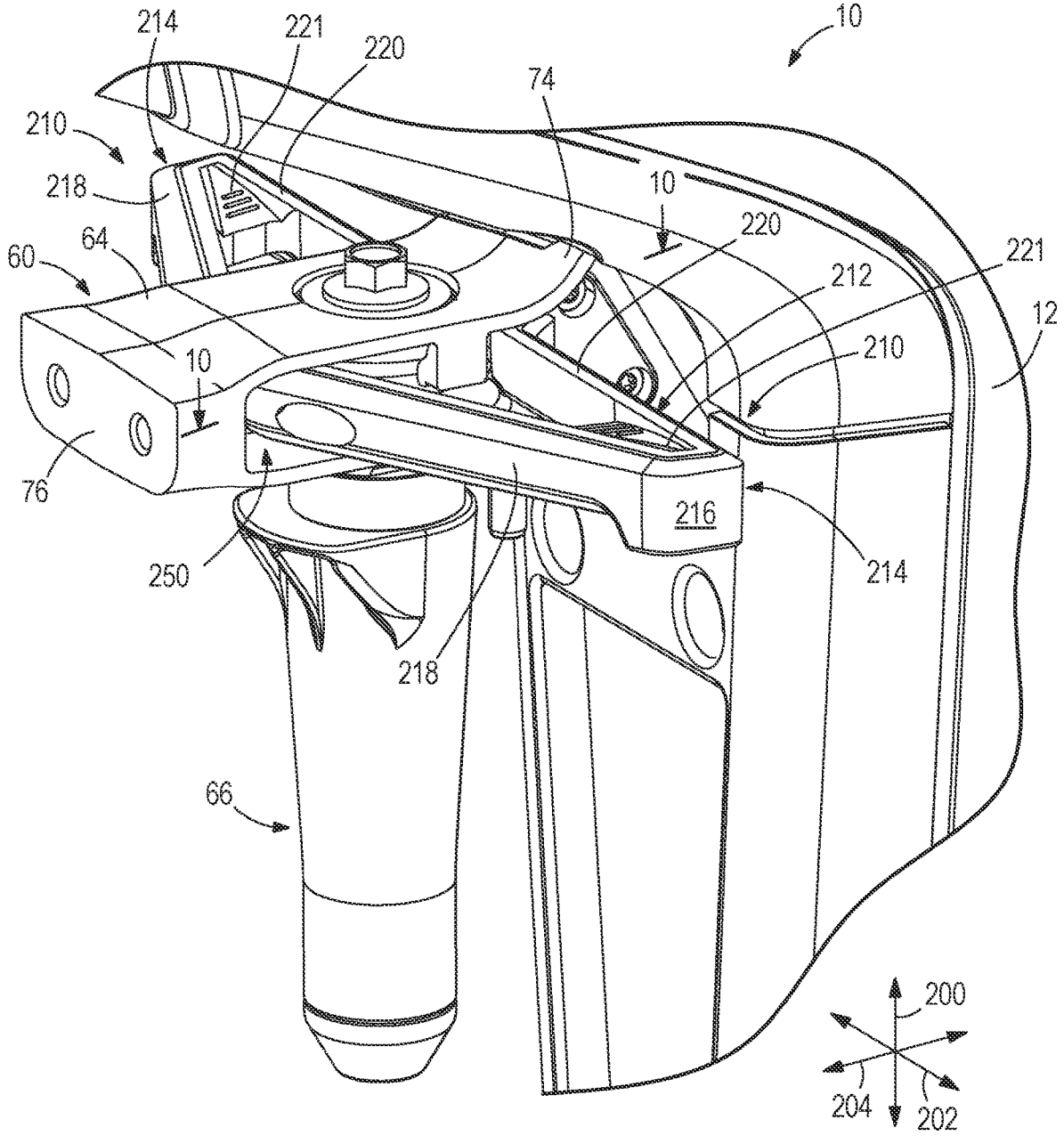
FIG. 8 is a perspective view of a steering arm extending forwardly from a midsection of the marine drive and wings extending laterally from the steering arm.

FIG. 7 depicts the mechanism 100 in the unlocked position after the end flange 116 has been pulled/slid radially outwardly away from the swivel tube assembly 66, as shown at arrow 202, thus removing the locking end 108 from over the top flange 118 of the annular locking flange 86. This frees or unlocks the outboard motor 10 for removal from the transom bracket assembly 30, as shown at arrow 204. Advantageously, the copilot arm 102 remains in position relative to the locking arm 104, i.e., regardless of whether the locking arm 104 is in the locked position or in the unlocked position. That is, the frictional engagement setting of the copilot arm 102 remains constant when the locking arm 104 is moved into and between the locked and unlocked positions, thus allowing the operator of the mechanism 100 to lock and unlock the apparatus without losing their preferred frictional engagement (i.e., their preferred resistance to steering setting).

It will thus be seen that the present disclosure provides a novel, integrated copilot and locking mechanism comprising both a copilot arm for retaining a steering bracket on a marine drive in each of a plurality of steering orientations and a locking arm configured to lock and alternately unlock the steering bracket relative to the transom bracket assembly, in particular such that in a locked position the marine drive is retained on the transom bracket assembly and such that in an unlocked position the marine drive is removable from the transom bracket assembly. The novel mechanism includes a single, multifunctional handle end (106, 116, 134) which is efficiently operable to cause the integrated copilot and locking mechanism to retain the steering bracket in each of the plurality of steering orientations, and which is also operable to cause the integrated copilot and locking mechanism to lock and alternately unlock the steering bracket and the transom bracket assembly relative to each other.

During research and development, the present inventors realized it would be desirable to configure a marine drive, for example an outboard motor, in such a way that it can be conveniently lifted from its position on a marine vessel, or from a side or rear laydown position, transported to another location, and then safely set back down on the ground or other supporting surface without causing damage to the cowling other fragile components of the marine drive. The present disclosure is a result of the present inventors efforts in this regard.

FIGS. 8-11 depict an embodiment of an outboard motor 10. The outboard motor 10 extends from top to bottom in an axial direction 200, from side to side in a lateral direction 202 which is perpendicular to the axial direction 200, and from front to rear in a longitudinal direction 204 which is perpendicular to the axial direction 200 and perpendicular to the lateral direction 202. Like the first embodiments described herein above, the outboard motor 10 has a cowling 12 and a lower gearcase 16 (see FIG. 11), which is located below the cowling 12. The outboard motor 10 also has the driveshaft housing 14 extending axially below the cowling 12 and located axially above lower gearcase 16. Together, the lower portions of the cowling 12 and the driveshaft housing 14 constitute a midsection 217 (see FIG. 13) of the outboard motor 10, which is located axially between the upper portions of the cowling 12 and the lower gearcase 16. A steering bracket 60 having a steering arm 64 extends forwardly from the midsection 217. As described herein above regarding the embodiments shown in FIGS. 1-7, the first end 74 of the steering arm 64 is rigidly fastened to a supporting frame or other supporting component of the outboard motor 10. The opposite, second end 76 of the steering arm 64 is fixed to a conventional tiller handle 78. As described herein above, the type and configuration of the tiller handle 78 can vary from what is shown and described. In the illustrated example, the tiller handle 78 is disclosed in the presently incorporated U.S. Pat. No. 9,764,813. As disclosed in U.S. Pat. No. 9,764,813 and as shown in the present disclosure by comparison of FIGS. 1 and 14, the tiller handle 78 is pivotable into and between a use position (FIG. 1) for steering of the outboard motor 10 and a storage position (FIGS. 13-14) for manual transport of the outboard motor 10, as will be further described herein below, wherein the tiller handle 78 extends generally parallel to the swivel tube assembly 66.

As shown in FIGS. 8-11, first and second wings 210 extend from laterally opposite sides of the outboard motor 10, laterally from opposite sides of the steering arm 64. The wings 210 are located rearwardly of the noted tiller handle 78 and transom bracket assembly 30 with respect to the longitudinal direction 204, and forwardly of the noted midsection 217 of the outboard motor 10. Each wing 210 has a frame 212 with an inner end fastened to the steering arm 64 and an outer end providing a footing 214. The footing 214 has a laterally outer, planar surface 216 for supporting the outboard motor 10 in a side laydown position, as will be further described herein below with reference to FIG. 13. Each wing 210 also has first and second arms 218, 220 which extend laterally outwardly from the steering arm 64 to the footing 214. The first and second arms 218, 220 extend at an acute angle $\alpha$ to each other, such that the frame 212 has a triangular shape when viewed from above, see FIG. 10, with the footing 214 located at the apex of the triangular shape, adjacent to the acute angle $\alpha$. Together, the first and second arms 218, 220 are configured to distribute the weight of the outboard motor 10 when the outboard motor 10 is in the noted side laydown position, as will be described herein below with reference to FIG. 13. A ribbed gripping surface 221 is located at the apex of the triangular shape. The ribbed gripping surface 221 facilitates easier manually grasping of the respective wing 210 during movement and/or transport of the outboard motor 10.

Figure 9:
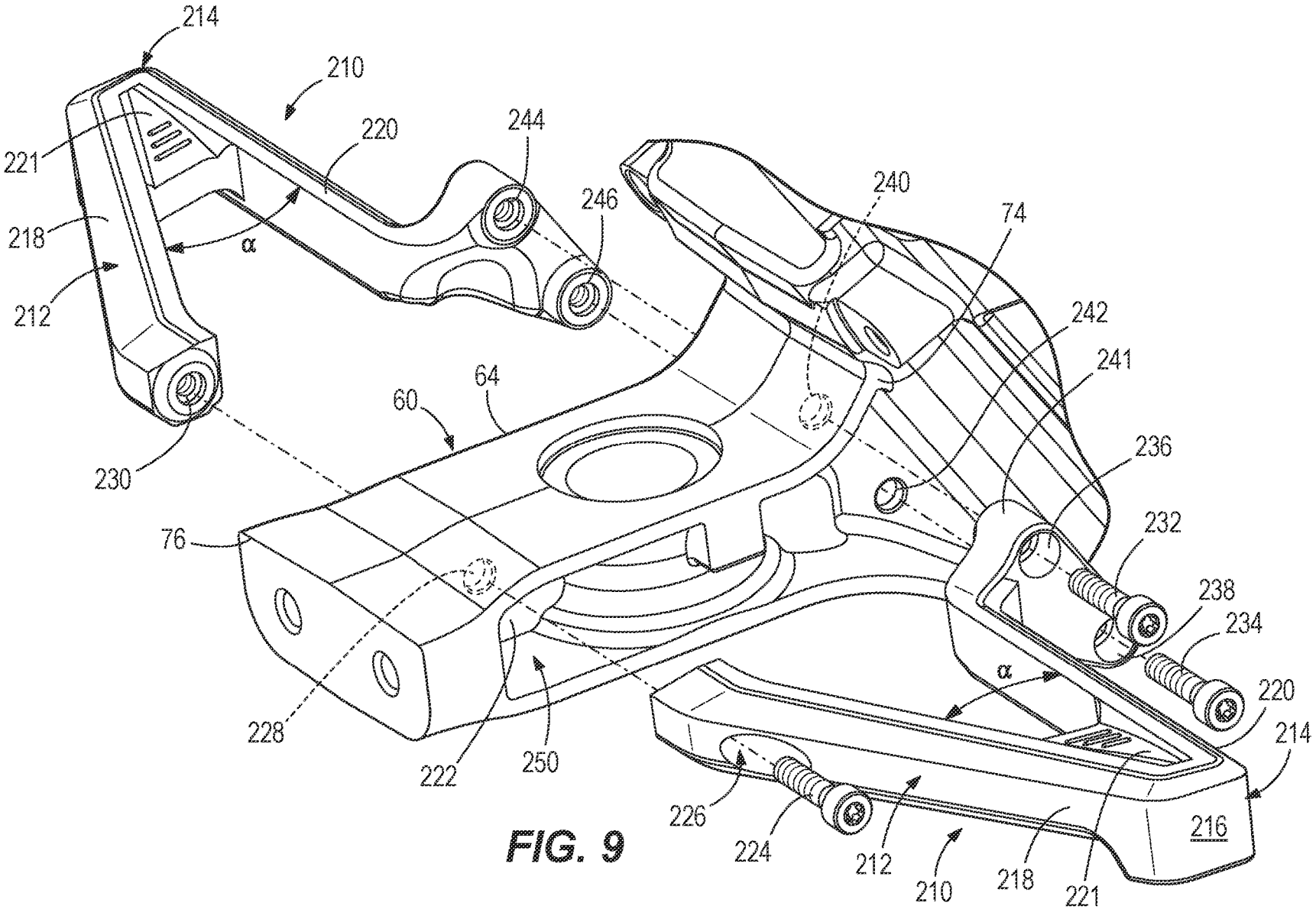
FIG. 9 is an exploded view of the steering arm and wings.
Figure 10:
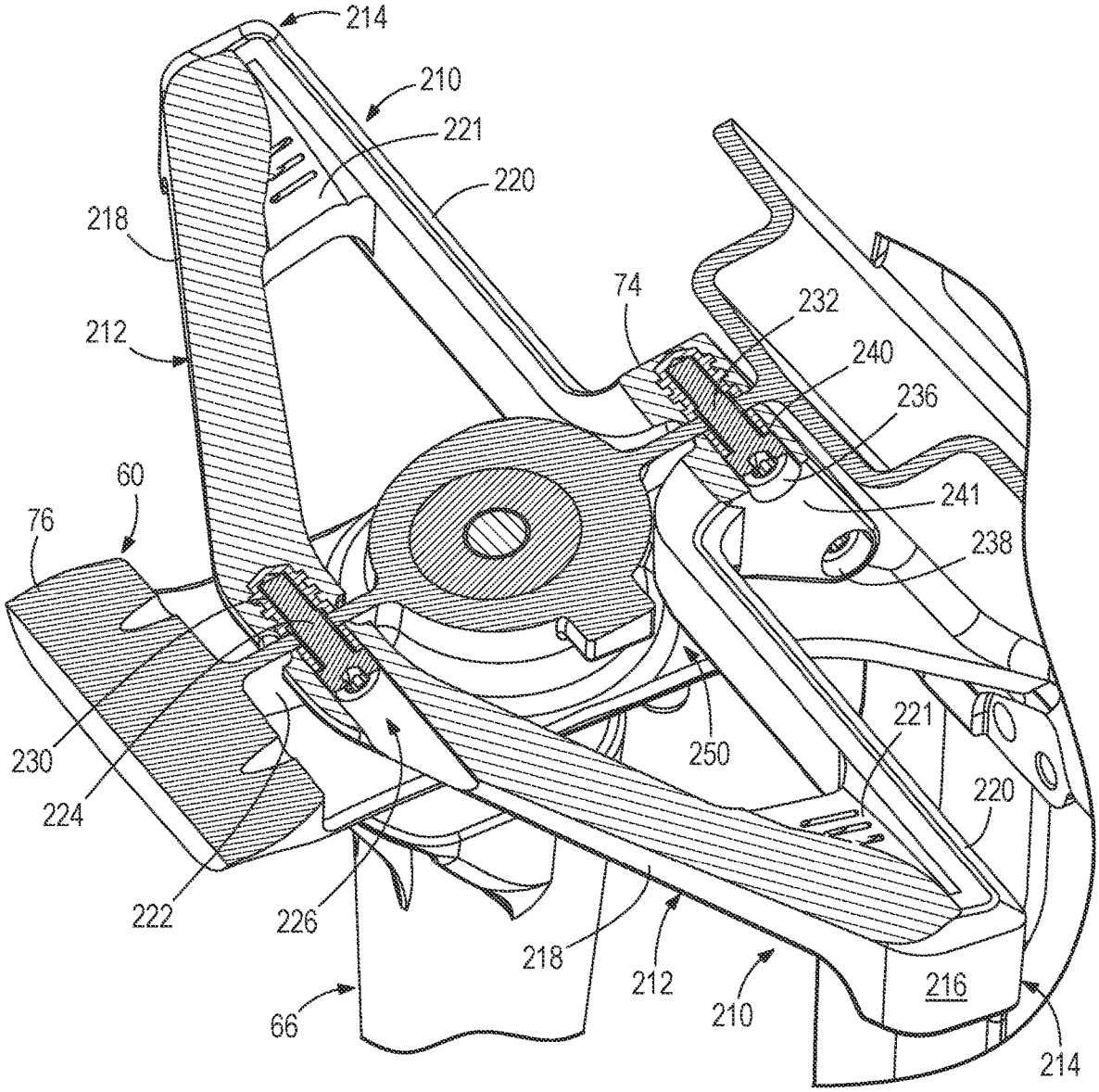
FIG. 10 is a view of section 10-10, taken in FIG. 10.
Figure 11:
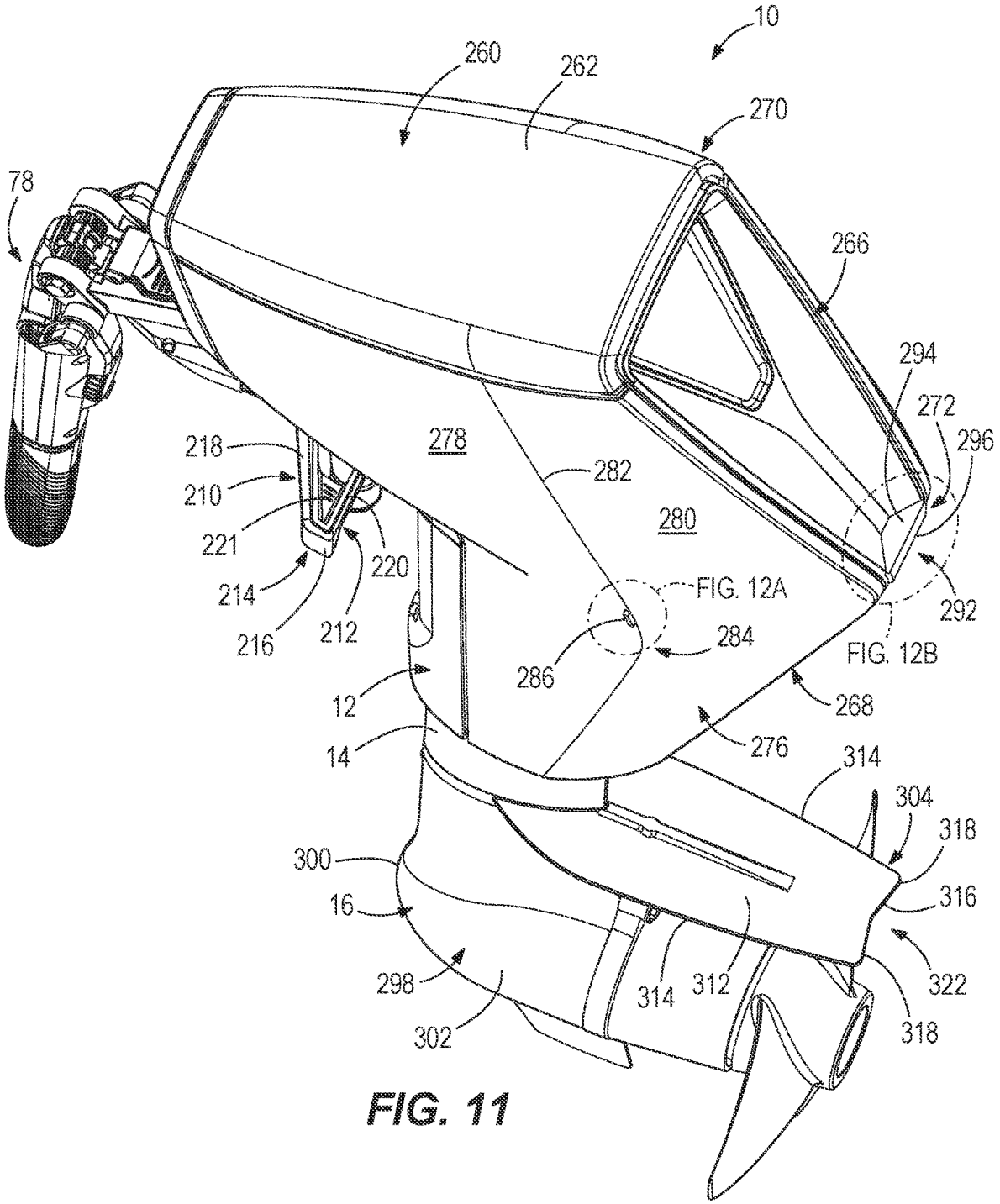
FIG. 11 is a side perspective view looking down at the marine drive.

At the inner end of the frame 212, each of the first and second arms 218, 220 are fastened to a center wall 222 of the steering arm 64 and also to the other wing 210. More specifically, as shown in FIG. 9, a front fastener 224 extends through a sunken bore 226 in the first arm 218 of the first wing 210, through a hole 228 in the center wall 222 and into threaded engagement with a counter bore 230 in the first arm of 218 of the second wing 210. Similarly, rear fasteners 232, 234 extend through sunken bores 236, 238 in an end flange 241 on the second arm 220 of the second wing 210, through holes 240, 242 in the center wall 222 and into threaded engagement with counter bores 244, 246 in the first arm 218 of the second wing 210. As shown, the wings 210 extend on opposite sides of the swivel tube assembly 66, with the first arm 218 located forwardly of the swivel tube assembly 66 and the second arm 220 located rearwardly of the swivel tube assembly 66. The inner ends of the frames 212 are disposed in recesses 250 located on opposite sides of the steering arm 64, in particular defined by the space between the center wall 222 and top and bottom walls 252, 254 of the steering arm 64.

As best shown in FIGS. 11-14, the cowling 12 has an angular outer profile and includes a top cowl surface portion 260 which is generally planar and extends upwardly from front to rear relative to the longitudinal direction 204. Optionally, in the illustrated example, the top cowl surface portion 260 includes a trap door 262 providing access to the powerhead compartment within the cowling 12. The cowling 12 also includes an angular backbone having an upper rear cowl surface portion 266 which extends downwardly and rearwardly from the top cowl surface portion 260, and a lower rear cowl surface portion 268 which extends downwardly and forwardly from the top cowl surface portion 260. A top apex portion 270 is defined at the transition between the top cowl surface and the upper rear cowl surface portion 266. A rear apex portion 272 is defined at the transition between the upper rear cowl surface portion 266 and the lower rear cowl surface portion 268. The cowling 12 also has opposing (first and second) lateral cowl side portion 276 located on opposite sides of the top cowl surface portion 260, the upper rear cowl surface portion 266 and the lower rear cowl surface portion 268. Each lateral cowl side portion 276 has a front side cowl portion 278 and a rear side cowl portion 280. The front and rear side cowl portions 278, 280 are joined by a laterally raised transition rib 282 which extends along the entire height of the cowling 12, from the top cowl surface portion 260 to the driveshaft housing 14. When viewed from the side, the raised transition rib 282 extends generally downwardly and rearwardly from the top cowl surface portion 260 to a side apex portion 284 located along the noted midsection 217 of the outboard motor 10, and then further downwardly and generally forwardly to the driveshaft housing 14. The front side cowl portion 278 extends laterally outwardly from its front side to the raised transition rib 282. The rear side cowl portion 280 extends laterally outwardly from its rear side to the raised transition rib 282.

Figure 12A:
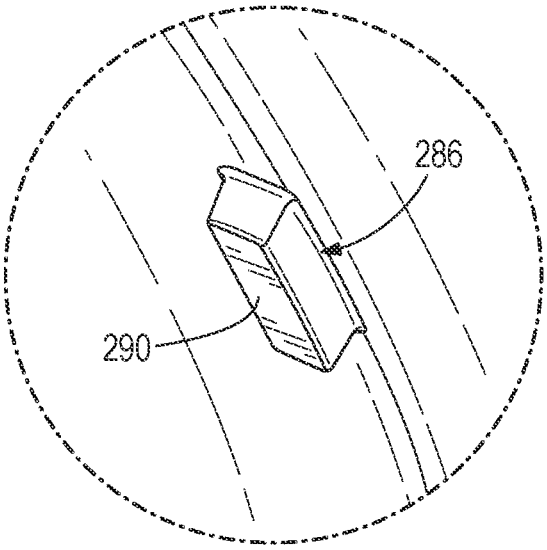
FIG. 12A is a detailed view taken in FIG. 11.
Figure 13:
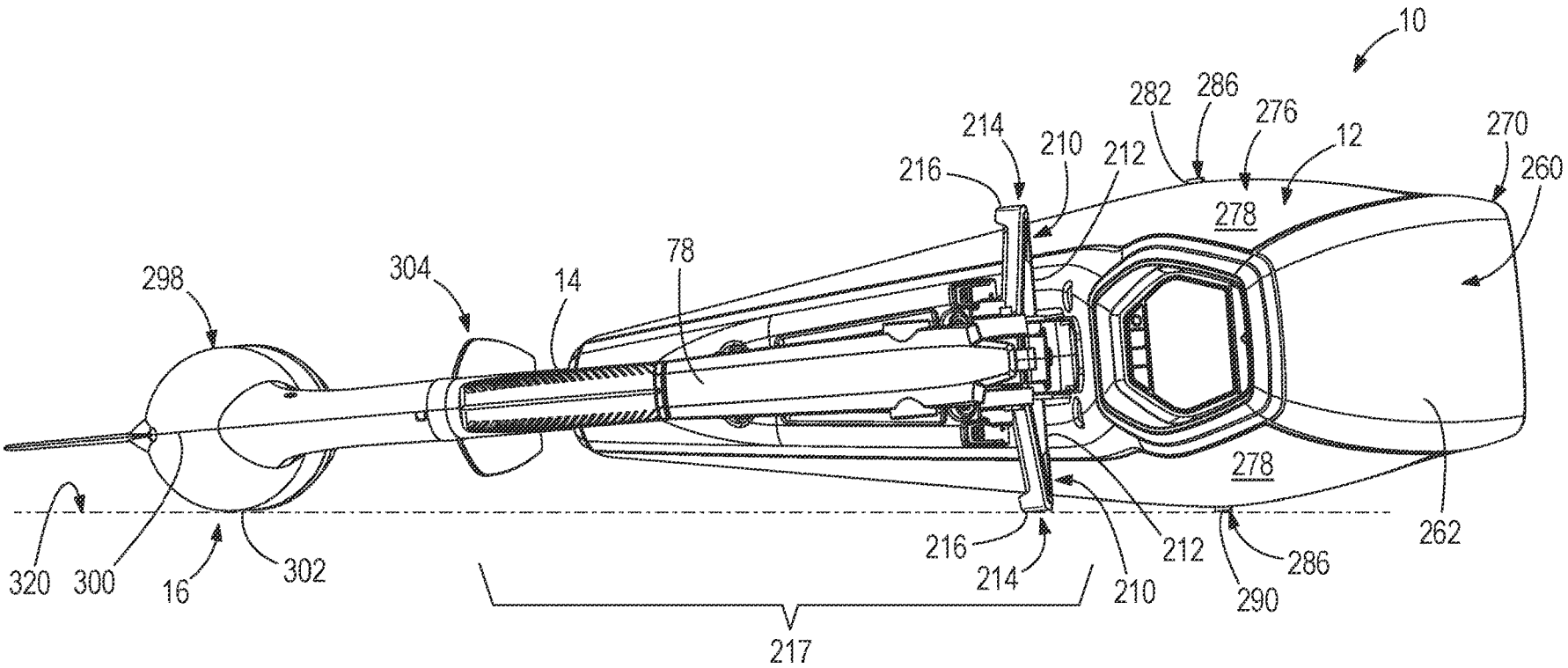
FIG. 13 is a front view showing the marine drive in a side laydown position.

Referring to FIGS. 12A and 13, a first support members 286 is located on each of the lateral cowl side portions 276, along the raised transition rib 282, proximate to the side apex portion 284. In the illustrated embodiment, each first support member 286 is a thickened portion of the sidewall of the cowling 12 (i.e., having an increased thickness compared to the surrounding portions of the cowling 12), which thus has an increased rigidity compared to the surrounding portions of the cowling 12, in particular such that the support member 286 is suitable for supporting the weight of the outboard motor 10 in a side laydown position, as will be further described herein below regarding FIG. 13. The first support member 286 has a planar laterally outer surface 290 for abutting the ground or other supporting surface on which the outboard motor 10 is placed.

Figure 12B:
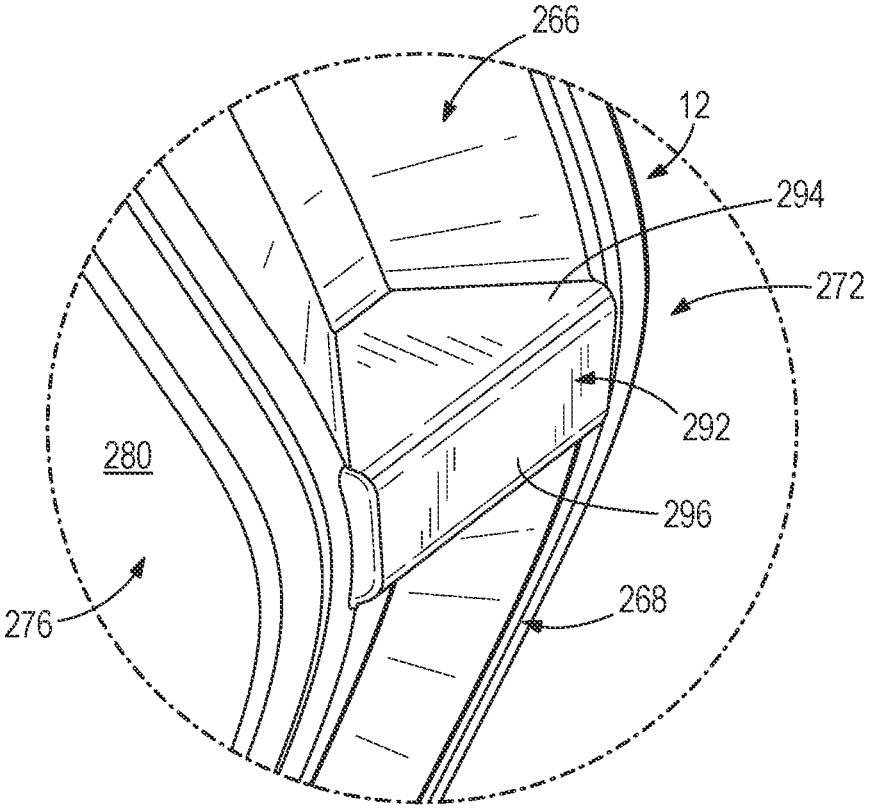
FIG. 12B is a detailed view taken in FIG. 11.
Figure 14:
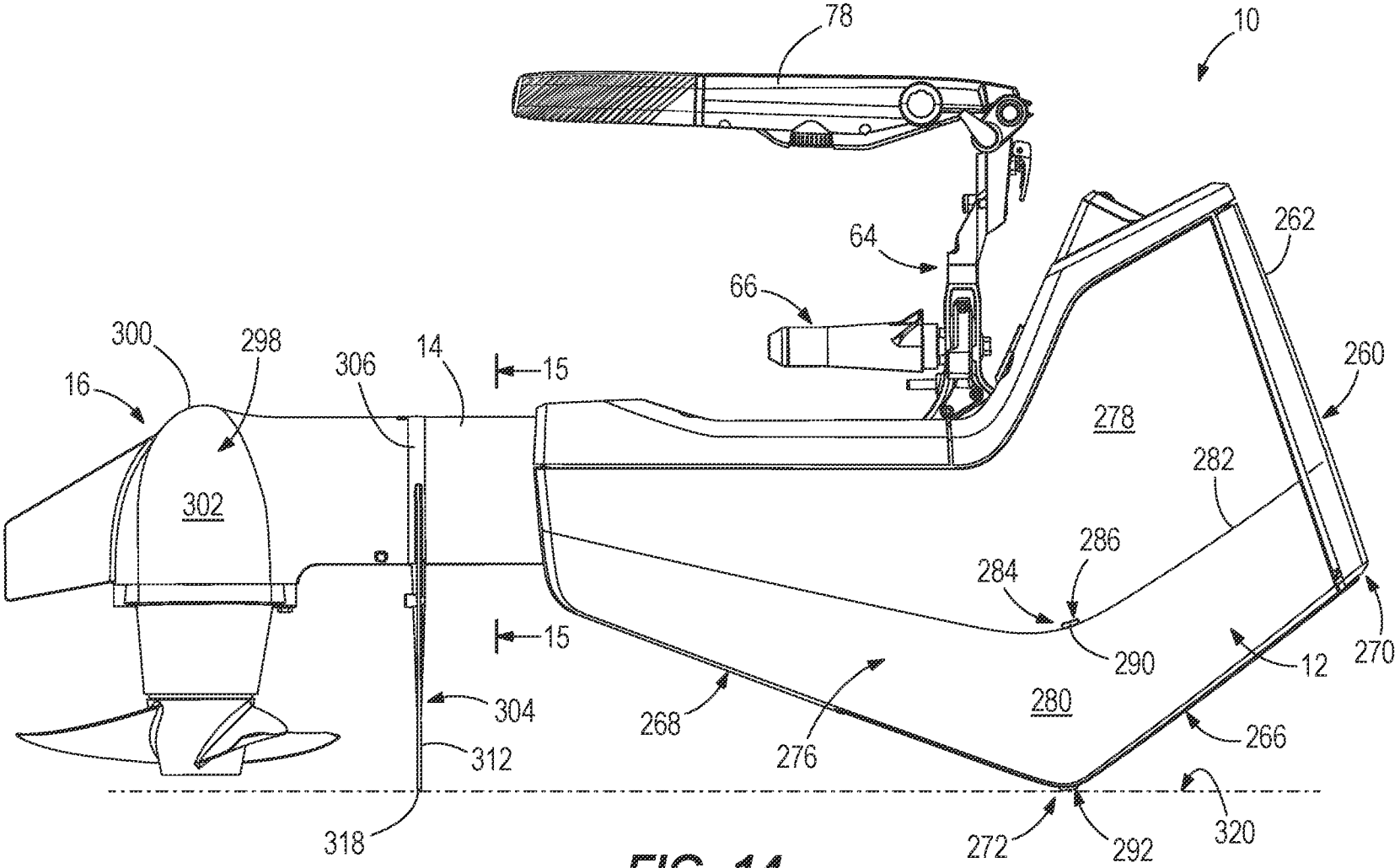
FIG. 14 is a side view showing the marine drive in a rear laydown position.

Referring to FIGS. 12B and 14, a second support member 292 is located on the rear apex portion 272 of the cowling 12. The second support member 292 comprises a laterally elongated rib 294 having a planar rear surface 296 for abutting the ground or other supporting surface on which the outboard motor 10 is placed.

Figure 15:
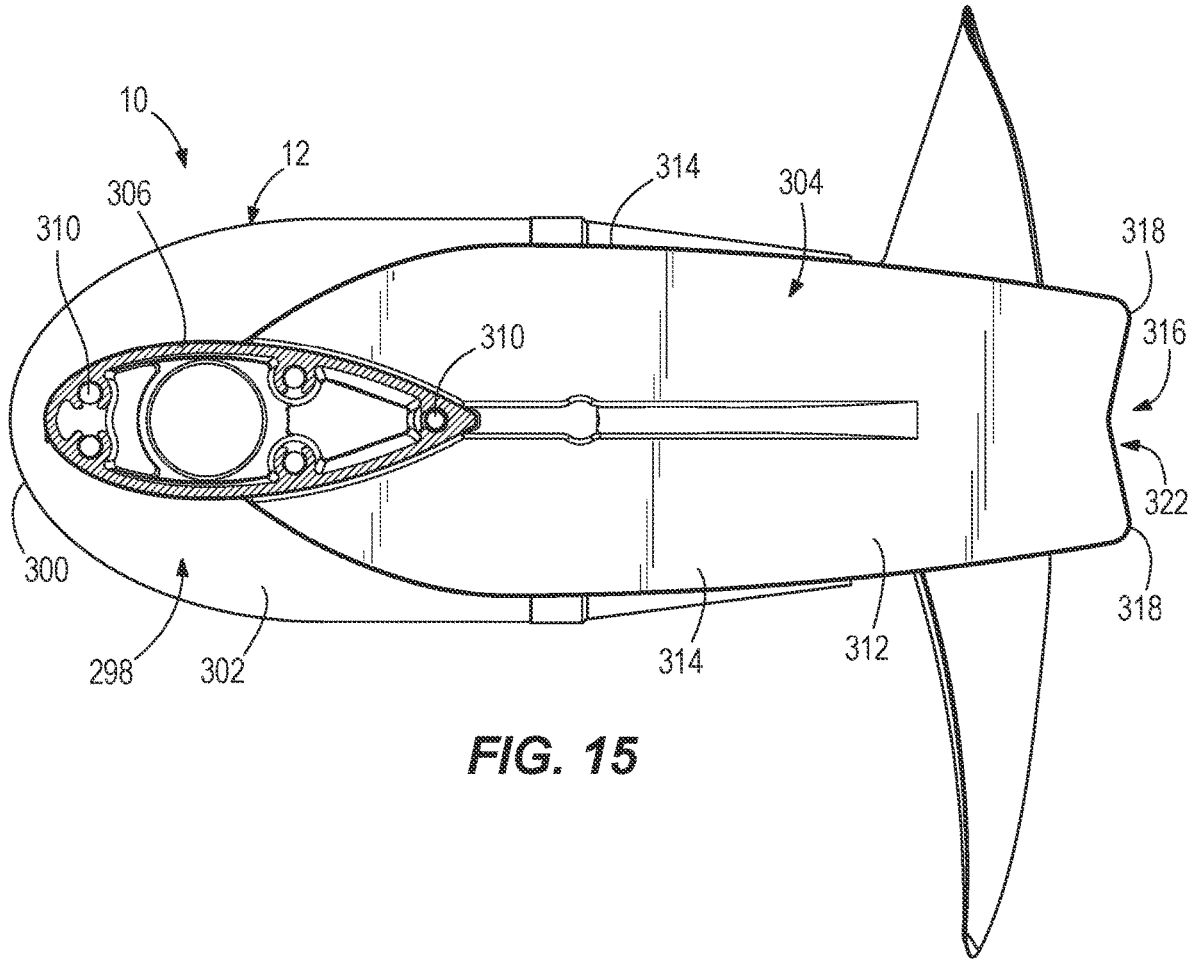
FIG. 15 is a view of section 15-15, taken in FIG. 14.
Figure 16:
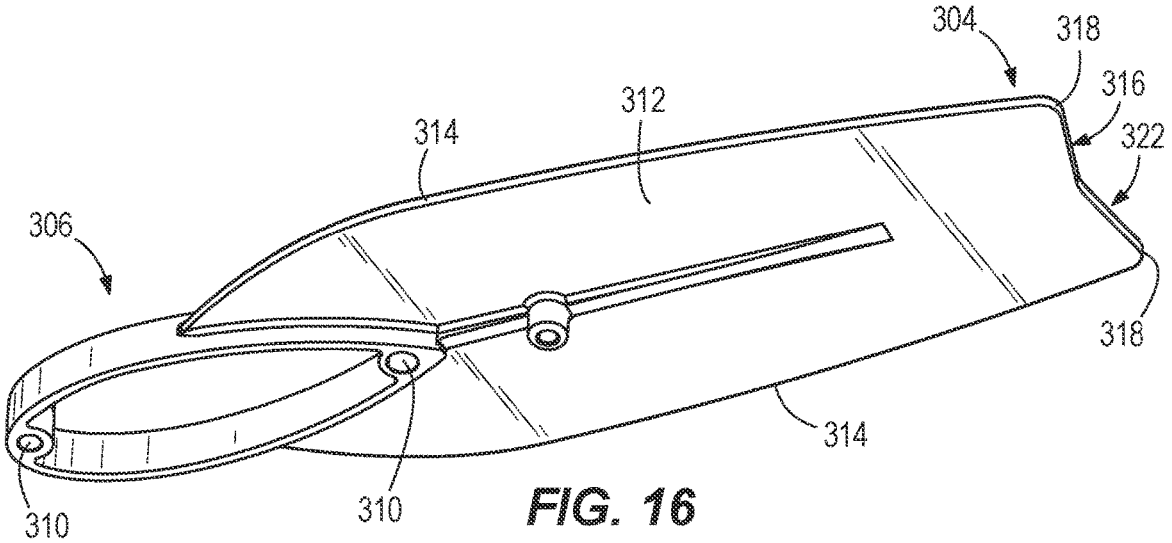
FIG. 16 is a perspective view looking up at an anti-ventilation plate of the marine drive.

Referring to FIGS. 11 and 13-16, the lower gearcase 16 has a torpedo housing 298 which is bullet-shaped, having a nose cone 300 which transitions outwardly from front to rear to a body portion 302 having a generally cylindrical outer diameter. As shown in FIGS. 15-16, an anti-ventilation plate 304 is located axially between the lower gearcase 16 and driveshaft housing 14. The anti-ventilation plate 304 has a head portion 306 that mounted to the lower portion of the driveshaft housing 14 and to the upper portion of the lower gearcase 16 by fasteners (not shown) extending through holes 310 in the head portion 306 and into engagement with one or both of the lower gearcase 16 and the driveshaft housing 14. The anti-ventilation plate 304 also has a tail portion 312, which is an elongated plate extending rearwardly from the head portion 306 and having laterally-outwardly curved sides 314 and a rear edge 316. The rear edge 316 has a spaced apart pair of laterally outer rear support members 318, which as described further herein below with reference to FIG. 14 support the outboard motor 10 in a rear laydown position. As shown in FIG. 15, the rear edge 316 has a V-shape with a valley 322, wherein the laterally rear support members 318 are the outermost edges of the V-shape of the tail portion 312 on opposite sides of the valley 322.

FIG. 13 depicts the outboard motor 10 in a side laydown position on a support surface 320. As shown, the outboard motor 10 is fully supported on the support surface 320 by a side tripod consisting of the outer, planar surface 216 of the footing 214 of the wing 210, the support member 286 on the lateral cowl side portion 276 of the cowling 12 that faces the support surface 320, and the lateral side of the lower gearcase 16 facing the support surface 320, particularly along the outer diameter of its body portion 302. It should be understood that FIG. 13 depicts the outboard motor 10 in one of two opposing side laydown positions, wherein only one of the wings 210 is configured to form the side tripod with the support member 286 and lateral side of the lower gearcase in one of the side laydown positions. In the depicted position, the opposing wing 210 along ribbed gripping surface 221 provides a convenient location to manually grasp and move the outboard motor 10. In addition or alternately, the tiller handle 78 and/or swivel tube assembly 66 provide convenient locations for grasping and lifting of the outboard motor 10.

FIG. 14 depicts the outboard motor 10 in a rear laydown position on the support surface 320. As shown, the outboard motor 10 is fully supported above the support on the support surface 320 by a rear tripod consisting of the planar rear surface 296 of the support member 292 on the rear apex portion 272 of the cowling 12 and the rear support members 318 on the tail portion 312 of the anti-ventilation plate 304. In this orientation, the tiller handle 78 and/or swivel tube assembly 66 provide convenient locations for grasping and lifting the outboard motor 10. In addition or alternately, either or both wings 210 can be manually grasped so as to lift the outboard motor 10.

It will thus be understood by one having ordinary skill in the art that the present disclosure provides improved outboard motor configurations that are easily and safely lifted, transported and then placed on the ground or on another supporting surface in a manner that reduces the chances of the outboard motor being damaged in the process. In use, a person can manually pivot the tiller handle into the storage position shown in FIGS. 13 and 14. The person can manually grasp the tiller handle and/or the swivel tube assembly and lift the outboard motor off the ground. After the person is done carrying the outboard motor, it can be safely set down in one of the side laydown positions or in the rear laydown position, wherein the outboard motor is safely supported by one of the side tripods or the rear tripod described above, such that the likelihood of damage to the more delicate portions of the outboard motor is advantageously reduced.

In the present description, certain terms have been used for brevity, clarity, and understanding. No unnecessary limitations are to be implied therefrom beyond the requirement of the prior art because such terms are used for descriptive purposes only and are intended to be broadly construed. The different apparatuses described herein may be used alone or in combination with other apparatuses. Various equivalents, alternatives and modifications are possible within the scope of the appended claims.

What is claimed is:

1. An outboard motor extending from top to bottom in an axial direction, from side to side in a lateral direction which is perpendicular to the axial direction, and from front to rear in a longitudinal direction which is perpendicular to the axial direction and perpendicular to the lateral direction, the outboard motor comprising a cowling, a gearcase, a midsection located axially between the cowling and the gearcase, a steering arm extending forwardly from the midsection, and a wing extending laterally from the steering arm, wherein the wing, a lateral side of the cowling, and a lateral side of the gearcase together define a substantially planar side tripod which supports the outboard motor in a side laydown position on a substantially flat surface.

2. The outboard motor according to claim 1, further comprising a transom bracket assembly for coupling the outboard motor to a marine vessel, wherein the wing is located rearwardly of the transom bracket assembly and forwardly of the midsection.

3. The outboard motor according to claim 1, further comprising a tiller handle extending forwardly from the steering arm, wherein the wing is located rearwardly of the tiller handle and forwardly of the midsection.

4. The outboard motor according to claim 1, further comprising a support member on the lateral side of the cowling, the support member being configured to support the outboard motor in the side laydown position, along with the wing and the lateral side of the gearcase.

5. The outboard motor according to claim 4, wherein the lateral side of the cowling comprises a sidewall which has a thickened portion along the support member.

6. The outboard motor according to claim 4, wherein the support member is planar.

7. The outboard motor according to claim 1, wherein the gearcase comprises a torpedo housing and wherein the lateral side of the gearcase is along an outer diameter of torpedo housing.

8. The outboard motor according to claim 1, wherein the wing comprises a frame having an inner end coupled to the steering arm and an outer end having a footing with a planar surface for supporting the outboard motor in the side laydown position, along with the lateral side of the cowling and the lateral side of the gearcase.

9. The outboard motor according to claim 8, wherein the frame comprises a plurality of arms which distribute loading from the weight of the outboard motor.

10. The outboard motor according to claim 9, wherein the plurality of arms comprises a first arm extending from the steering arm to the footing and a second arm extending from the steering arm to the footing, wherein the first and second arms extend at an angle to each other.

11. The outboard motor according to claim 10, wherein the frame has a triangular shape with the footing located at an apex of the triangular shape.

12. The outboard motor according to claim 1, wherein the lateral side of the cowling is a first lateral side of the cowling, wherein the lateral side of the gearcase is a first lateral side of the gearcase, wherein the wing is a first wing extending from a first lateral side of the steering arm, and wherein the side laydown position is a first side laydown position, and further comprising a second wing extending from a second lateral side of the steering arm which is opposite the first lateral side of the steering arm, wherein the second wing, a lateral second side of the cowling, and a lateral second side of the gearcase define a rear tripod which supports the outboard motor in a second side laydown position which is opposite the first side laydown position.

13. The outboard motor according to claim 1, further comprising:

a tiller handle extending forwardly from the steering arm, wherein the wing is located rearwardly of the tiller handle and forwardly of the midsection, and a support member on the lateral side of the cowling, the support member being configured to support the outboard motor in the side laydown position, along with the wing and the lateral side of the gearcase, wherein the wing comprises a frame having an inner end coupled to the steering arm and an outer end having a footing with a planar surface for supporting the outboard motor in the side laydown position, along with the lateral side of the cowling and the lateral side of the gearcase.

14. The outboard motor according to claim 1, further comprising an anti-ventilation plate between the midsection and the gearcase, the anti-ventilation plate having a rear edge with laterally outer rear support members, which together with the rear of the cowling form a substantially planar rear tripod which supports the outboard motor in a rear laydown position on a substantially flat surface.

15. The outboard motor according to claim 14, wherein the rear edge has a V-shape when viewed looking down at the anti-ventilation plate in the axial direction.

16. The outboard motor according to claim 15, wherein the rear of the cowling comprises a raised surface configured to support the outboard motor in the rear laydown position, along with the laterally outer rear support members.

17. The outboard motor according to claim 16, wherein the rear of the outboard motor comprises an angular backbone having angled surfaces which meet at an apex portion.

18. The outboard motor according to claim 17, further comprising a tiller handle for manually pivoting the outboard motor via a transom bracket assembly.

19. An outboard motor extending from top to bottom in an axial direction, from side to side in a lateral direction which is perpendicular to the axial direction, and from front to rear in a longitudinal direction which is perpendicular to the axial direction and perpendicular to the lateral direction, the outboard motor comprising a cowling, a gearcase, a midsection located axially between the cowling and the gearcase, and an anti-ventilation plate between the midsection and the gearcase, the anti-ventilation plate having a rear edge with laterally outer rear support members, which together with the rear of the cowling form a rear tripod which supports the outboard motor in a substantially planar rear laydown position on a substantially flat surface.

20. An outboard motor extending from top to bottom in an axial direction, from side to side in a lateral direction which is perpendicular to the axial direction, and from front to rear in a longitudinal direction which is perpendicular to the axial direction and perpendicular to the lateral direction, the outboard motor comprising:

a cowling, a gearcase, a midsection located axially between the cowling and the gearcase, a steering arm extending forwardly from the midsection, a wing extending laterally from the steering arm, wherein the wing, a lateral side of the cowling, and a lateral side of the gearcase together define a substantially planar side tripod which supports the outboard motor in a side laydown position on a substantially flat surface, and an anti-ventilation plate between the midsection and the gearcase, the anti-ventilation plate having a rear edge with laterally outer rear support members, which together with the rear of the cowling form a substantially planar rear tripod which supports the outboard motor in a rear laydown position on a substantially flat surface.

* * * * *